US011131500B2

(12) United States Patent
Kim

(10) Patent No.: US 11,131,500 B2
(45) Date of Patent: Sep. 28, 2021

(54) REFRIGERATOR INCLUDING LIGHTING UNIT WITH AIR GUIDE

(71) Applicant: LG Electronics Inc., Seoul (KR)

(72) Inventor: Jinsung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 117 days.

(21) Appl. No.: 16/557,495

(22) Filed: Aug. 30, 2019

(65) Prior Publication Data

US 2020/0072542 A1 Mar. 5, 2020

(30) Foreign Application Priority Data

Aug. 30, 2018 (KR) ..... 10-2018-0102992

(51) Int. Cl.
*F25D 27/00* (2006.01)
*F25D 29/00* (2006.01)
(Continued)

(52) U.S. Cl.
CPC ..... *F25D 29/003* (2013.01); *F25D 11/02* (2013.01); *F25D 17/062* (2013.01);
(Continued)

(58) Field of Classification Search
CPC .... F25D 17/062; F25D 17/067; F25D 23/028; F25D 25/025; F25D 27/00; F25D 2317/062; F25D 2317/063
See application file for complete search history.

(56) References Cited

U.S. PATENT DOCUMENTS 3,177,678 A * 4/1965 Facey, Jr. ..... F25D 21/04 62/272
6,062,037 A * 5/2000 Yoon ..... F25D 17/065 62/407
(Continued)

FOREIGN PATENT DOCUMENTS

CN 102914113 2/2013
CN 105953499 9/2016
(Continued)

OTHER PUBLICATIONS

EP Search Report in European Application No. EP 19194359, dated Jan. 20, 2020, 5 pages.
(Continued)

*Primary Examiner* — Jonathan Bradford
(74) *Attorney, Agent, or Firm* — Fish & Richardson P.C.

(57) ABSTRACT

A refrigerator includes a cabinet that defines a storage chamber, a heat exchange space that is defined by the cabinet and positioned rearward of the storage chamber, an evaporator unit that is provided at the heat exchange space, a grill fan assembly that provides a barrier between the heat exchange space and the storage chamber, a drawer door that is configured to be inserted into and withdrawn out of the storage chamber, a draw-out rail provided between an inner surface of the lower storage chamber and both lateral sides of the drawer door to guide a movement of the drawer door into and out of the storage chamber, and a lighting unit provided at a rear surface of the door part and configured to illuminate the drawer part and to guide air coming from the outlet of the grill fan assembly in a downward direction into the storage space.

20 Claims, 31 Drawing Sheets

(51) Int. Cl.

| | |
|---|---|
| ***F25D 11/02*** | (2006.01) |
| ***F25D 17/06*** | (2006.01) |
| ***F25D 23/02*** | (2006.01) |
| ***F25D 25/02*** | (2006.01) |

(52) U.S. Cl.
CPC ..... *F25D 17/065* (2013.01); *F25D 23/021* (2013.01); *F25D 25/021* (2013.01); *F25D 25/025* (2013.01); *F25D 27/00* (2013.01); *F25D 2317/063* (2013.01); *F25D 2325/021* (2013.01); *F25D 2500/06* (2013.01)

(56) References Cited

U.S. PATENT DOCUMENTS

| | | | | |
|---|---|---|---|---|
| 7,147,341 | B2 | 12/2006 | Nowak et al. | |
| 8,336,330 | B2 * | 12/2012 | Lee | F25C 5/22 62/442 |
| 9,377,238 | B2 | 6/2016 | Hall et al. | |
| 2006/0077653 | A1 | 4/2006 | Nowak et al. | |
| 2007/0137242 | A1 * | 6/2007 | Marques | F25D 17/062 62/407 |
| 2018/0231296 | A1 * | 8/2018 | Marinello | F25D 23/087 |

FOREIGN PATENT DOCUMENTS

| | | | | |
|---|---|---|---|---|
| CN | 107062751 | | 8/2017 | |
| EP | 2924378 | | 9/2015 | |
| JP | 10103843 | A * | 4/1998 | |
| JP | 2001174125 | | 6/2001 | |
| KR | 1020070055904 | | 5/2007 | |
| KR | 1020100054633 | | 5/2010 | |
| KR | 1020150024144 | | 3/2015 | |
| KR | 1020180052516 | | 5/2018 | |
| WO | WO2012067354 | | 5/2012 | |
| WO | WO-2014198152 | A1 * | 12/2014 | F25D 17/045 |

OTHER PUBLICATIONS

Chinese Office Action in Chinese Appln. No. 201910717514.1, dated Jan. 28, 2021, 11 pages (with English translation).

* cited by examiner

REFRIGERATOR INCLUDING LIGHTING UNIT WITH AIR GUIDE

CROSS-REFERENCE TO RELATED APPLICATIONS

The present application claims priority under 35 U.S.C. 119 and 35 U.S.C. 365 to Korean Patent Application No. 10-2018-0102992, filed on Aug. 30, 2018, which is hereby incorporated by reference in its entirety.

TECHNICAL FIELD

The present disclosure relates to a refrigerator.

BACKGROUND

In general, refrigerators are home appliances for storing foods at a low temperature in a storage space that is covered by a door. Generally, refrigerators cool the inside of the storage space by using cool air generated by being heat-exchanged with a refrigerant circulated through a refrigeration cycle to store foods in an optimum state.

Recently, refrigerator are becoming larger and more multifunctional as dietary changes and user's preferences become more diverse, and thus, a refrigerator having various structures and convenience devices for user's convenience and freshness of stored foods have been introduced.

The storage space of the refrigerator may be opened and closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer-type door that is inserted and withdrawn in a drawer manner.

Also, the drawer-type door is often disposed in a lower region of the refrigerator. Thus, when the drawer-type door is disposed in the lower region of the refrigerator, a user has to bend his/her back to take out a basket or foods in the drawer-type door. If the basket or the foods are heavy, the user may find it inconvenient to use the basket and/or may be injured.

SUMMARY

According to one aspect of the subject matter described in this application, a refrigerator includes a cabinet that defines a storage chamber, a heat exchange space that is defined by the cabinet and positioned rearward of the storage chamber, an evaporator unit that is provided at the heat exchange space, a grill fan assembly that provides a barrier between the heat exchange space and the storage chamber, the grill fan including an inlet for receiving air from the storage chamber, an outlet for sending air to the storage chamber, and a fan for circulating air between the storage chamber and the heat exchange space, a drawer door that is configured to be inserted into and withdrawn out of the storage chamber, the drawer door including a drawer part that defines an upwardly open storage space and a door part that is configured to, based on the drawer door being inserted into and withdrawn out of the storage chamber, open and close the storage chamber, respectively, a draw-out rail provided between an inner surface of the lower storage chamber and both lateral sides of the drawer door, the draw-out rail being configured to guide a movement of the drawer door into and out of the storage chamber, and a lighting unit provided at a rear surface of the door part and configured to illuminate the drawer part, the lighting unit including an upper air guide that extends vertically to a position vertically higher than an upward facing opening of the storage space, the upper air guide being configured to guide air coming from the outlet of the grill fan assembly in a downward direction into the storage space.

Implementations according to this aspect may include one or more of the following features. For example, the lighting unit may extend in a horizontal direction along a width of the drawer part and has a width equal to or greater than that of the drawer part. The upper air guide may protrude increasingly rearward toward an upper side of the door part and has an inclined or rounded shape. In some cases, the lighting unit may include a lighting module configured to emit light and including a substrate on which a plurality of light emitting diodes (LEDs) are disposed along a longitudinal direction, a lighting case on which the lighting module is mounted, and a lighting cover that covers the lighting case, the lighting cover being made from a transparent material and configured to allow at least a portion of light emitted from the lighting module to pass therethrough. Here, the upper air guide may be disposed on the lighting cover.

In some implementations, the lighting case may define a module mounting groove into which the substrate of the lighting module is inserted and in which the lighting module is mounted such that the LEDs emit light in an upward direction. In some cases, the lighting case includes a reflection part having a rounded or inclined shape and configured to reflect light emitted from the lighting module at a lower side of the lighting unit toward the drawer part. The upper air guide may be spaced apart from a front surface of the drawer part to thereby guide cold air to flow along a rear surface of the door part and the front surface of the drawer part. The outlet and the upper air guide are disposed vertically higher than an upper end of the drawer part. In some cases, the drawer part may include an elevation device configured to support and vertically elevate food items, and the door part may include a driving device that is configured to transmit a driving force to the elevation device to thereby vertically elevate the food items.

In some implementations, the door part may include an outer case that defines an outer appearance, a door liner that is coupled to the outer case, the door liner defining a rear surface of the door part in which a recess part configured to accommodate the driving device is defined, an insulation material filled between the door case and the door liner, and a door cover that is mounted on the door liner and that covers the driving device. In some cases, the door cover may extend vertically higher than the lighting module and is disposed at a rear side of the door liner to cover the lighting module. Also, an extension part that is stepped may be disposed on a lower end of the upper air guide, and the door cover may extend upward to an upper end of the extension part to cover the lighting cover.

In some cases, a lower end of the upper air guide and an upper end of the door cover may contact each other such that cool air guided by the upper air guide flows along the door cover. A lower end of the door cover may include a lower air guide that protrudes rearward, that has an inclined or rounded shape, and that is configured to guide cold air flowing along the door cover to a lower side of the drawer part. In some cases, the lower air guide may protrude further rearward than a lower end of the drawer part. In some cases, the drawer part may include a drawer body that defines the storage space, and a plurality of metal plates mounted on inner and outer surfaces of the drawer body to cover the rail, the plurality of metal plates defining an outer appearance of the drawer body.

According to another aspect, a refrigerator includes a cabinet that defines a storage chamber, a drawer door that is configured to be inserted into and withdrawn out of the storage chamber, the drawer door including a door part that is configured to open and close the storage chamber and a drawer part disposed at a rear side of the door part and defining a storage space, a door frame that couples the door part to the drawer part in a state in which they are spaced apart from each other, an upper air guide disposed on a rear surface of the door part, the upper air guide being disposed vertically higher than an upper end of the drawer part and configured to guide cold air to a space between the door part and the drawer part, and a lower air guide disposed on the rear surface of the door part, the lower air guide being disposed vertically lower than a lower end of the drawer part and configured to guide the cold air guided by the upper air guide rearward from a front side along a bottom surface of the drawer part.

Implementations according to this aspect may include one or more of the following features. For example, the upper air guide may protrude rearward from a lower side of the door part toward an upper side of the door part and has an inclined or rounded shape, and the lower air guide may protrude from the upper side of the door part toward the lower side door part and has an inclined or rounded shape. A lighting unit may be disposed on the rear surface of the door part, the lighting unit being disposed above the drawer part and configured to emit light to the drawer part, and the upper air guide may be disposed on the lighting unit. Also, the lighting unit may extend in a horizontal direction along a width of the drawer part and has a width equal to or greater than that of the drawer part.

The details of one or more implementations are set forth in the accompanying drawings and the description below. Other features will be apparent from the description and drawings, and from the claims.

DETAILED DESCRIPTION

Hereinafter, implementations of the present disclosure will be described in detail with reference to the accompanying drawings.

Figure 1:
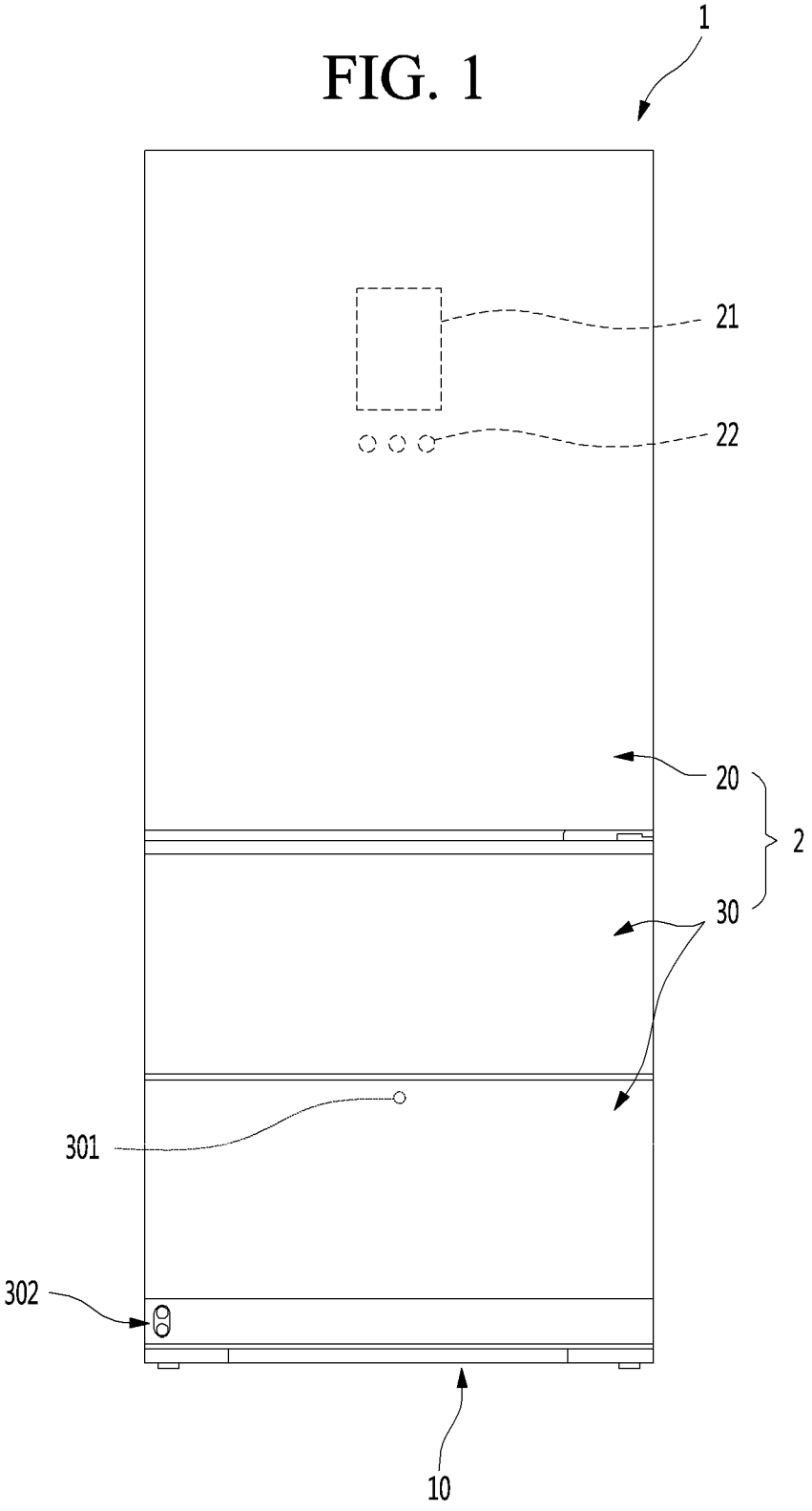
FIG. 1 is a front view of a refrigerator according to an implementation.
Figure 2:
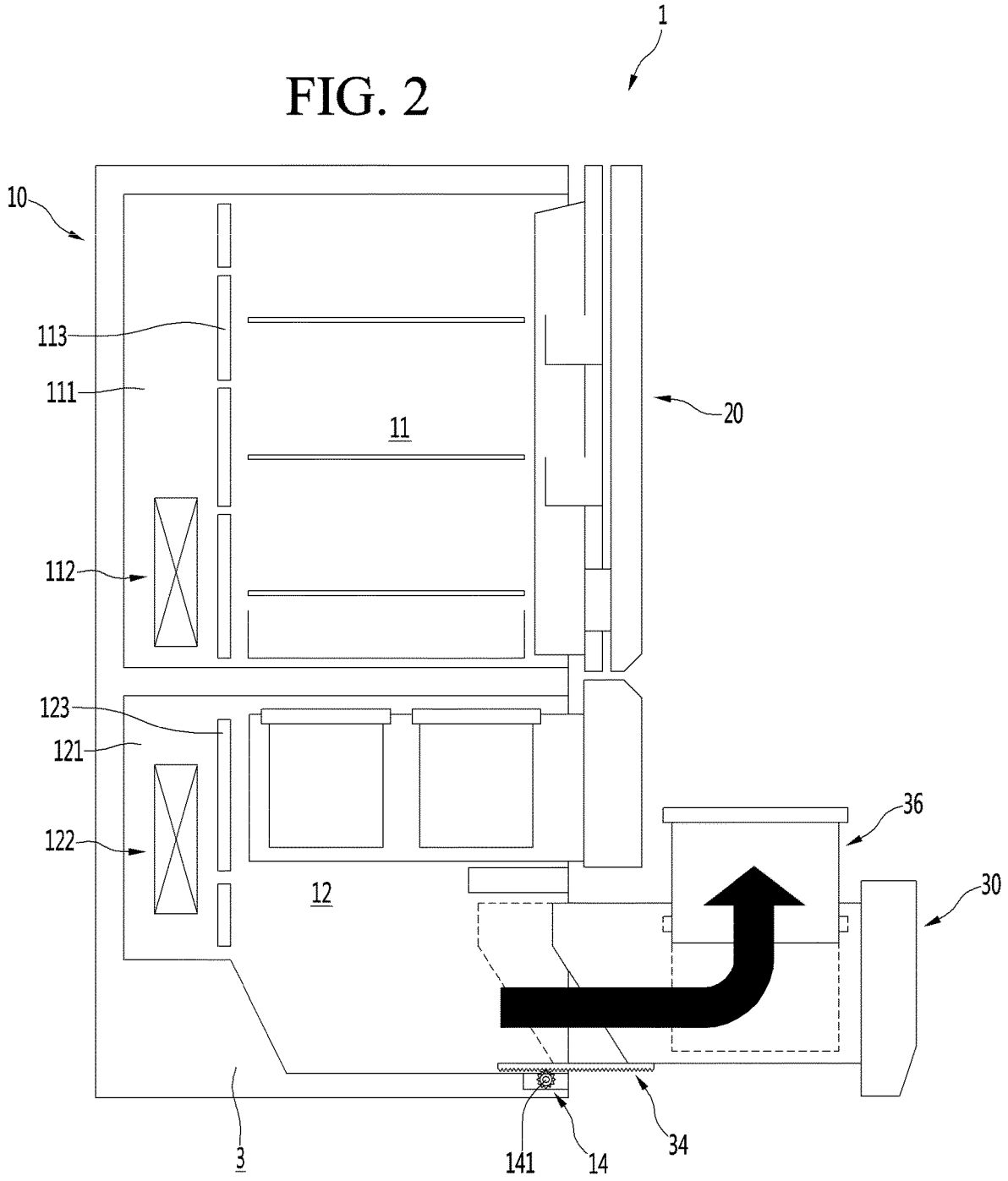
FIG. 2 is a schematic view illustrating a state in which a drawer door of the refrigerator is elevated.

FIG. 1 is a front view of a refrigerator according to an implementation. Also, FIG. 2 is a schematic view illustrating a state in which a drawer door of the refrigerator is elevated.

As illustrated in the drawing, the refrigerator 1 may have an outer appearance that is defined by a cabinet 10 defining a storage chamber and a door 2 covering an opened front surface of the cabinet 10.

The storage chamber of the cabinet 10 may be divided into a plurality of spaces. For example, an upper storage chamber 11 of the cabinet 10 may be provided as a refrigerating compartment, and a lower storage chamber 12 may be provided as a freezing compartment. Alternatively, the upper storage chamber and the lower storage chamber 12 may be provided as independent spaces that are maintained at temperatures different from each other, but are not the refrigerating compartment or the freezing compartment. Also, the lower storage chamber 12 may be divided into a plurality of spaces. As illustrated in the drawings, one space may be opened and closed by a plurality of doors 20 and 30.

Heat exchange spaces 111 and 121 that are partitioned by grill fan assemblies 113 and 123 may be provided behind the upper storage chamber 11 and the lower storage chamber 12, and an upper evaporator unit 112 and a lower evaporator unit 122 may be respectively disposed in the heat exchange spaces 111 and 121. A fan may be further provided in the heat exchange spaces 111 and 121. Thus, cool air may be supplied to the upper storage chamber 11 and the lower storage chamber 12 by driving of the fan.

The cool air generated in the evaporator units 112 and 122 may be supplied to the upper storage chamber 11 and the lower storage chamber 12 through outlets of the grill fan assemblies 113 and 123 by the operation of the fan and also be collected into inlets of the grill fan assemblies 113 and 123 to circulate.

In some implementations, only one evaporator unit 112 or 122 unit may be provided. Thus, the cool air discharged from one evaporator unit may be branched to be supplied into the upper storage chamber 11 or the lower storage chamber 12.

The present implementation may relate to a structure for cooling the lower storage chamber 12. Hereinafter, the lower storage chamber 12 may be referred to as a storage chamber, and the lower evaporator unit 122 may be referred to as an evaporator unit.

The door 2 may include a rotation door 20 for opening and closing the upper space through rotation thereof and a drawer door 30 for opening and closing the lower space by being inserted or withdrawn in a drawer type configuration. The lower space may further be vertically divided into two separate spaces. The drawer door 30 may include an upper drawer door 30 and a lower drawer door 30. In some cases, an outer appearance of each of the rotation door 20 and the drawer door 30 may be made of a metal material and be exposed to the front side.

Although the refrigerator in which both the rotation door 20 and the drawer door 30 are provided is described, the present disclosure is not limited thereto. For example, the present disclosure may be applied to all refrigerators including a door that is inserted and withdrawn in the drawer type. Also, the rotation door 20 may be provided at an upper portion and thus called an upper door, and the drawer door 30 may be provided at a lower portion and thus called a lower door.

A display 21 may be disposed on one side of a front surface of the rotation door 20. In some cases, when the outer appearance of the door 2 is made of the metal material, a plurality of fine holes may be punched in the display 21 to display information by using light passing therethrough.

In some implementations, a manipulation part 22 that is capable of manipulating automatic rotation or withdrawal of the upper door 2 or the lower door 2 may be provided on one side of the rotation door 20. The manipulation part 22 may be integrated with the display 21 and may operate in a touch manner or a button manner. The manipulation part 22 may input an overall operation of the refrigerator 1 and manipulate an insertion and withdrawal of the drawer door 30 or an elevation within the drawer door.

A manipulation part 301 may also be provided on the drawer door 30. The manipulation part 301 may be disposed on one side of the drawer door 30 that is disposed at the lowermost portion of the drawer door 30. The manipulation part 301 may operate in a touch or button manner. The manipulation part 301 may be provided as a sensor detecting proximity or movement of a user or provided as an input unit that operates by a user's motion or voice.

As illustrated in the drawings, a manipulation device 302 may be disposed on a lower end of the lower drawer door 30 to illuminate an image on a bottom surface and thereby to output a virtual switch and to input an operation when the user approaches a corresponding area.

The lower drawer door 30 may be automatically inserted and withdrawn according to the manipulation of the manipulation part 301. In some cases, a food or container within the lower drawer door 30 may be elevated in a state in which the drawer door 30 is withdrawn by the manipulation of the manipulation part 301.

The lower drawer door 30 may be a storage chamber defined in a lower side of the refrigerator 1 and may withdraw the lower drawer door 30 forward to accommodate a food stored in the lower drawer door 30, and then, the container 36 inside the drawer door 30 may be manipulated to be elevated.

The container 36 may have a predetermined height. Since the container 36 is seated on the elevation device 80, the height of the container 36 may increase by the height of the elevation device 80 when the elevation device 80 is elevated. Thus, when the elevation device 80 ascends, the container 36 may be disposed at a point at which the user is able to more easily access the container 36 and also more easily lift the container 36.

The container 36 may be completely accommodated in the accommodation part 32 when the door 30 is inserted and withdrawn. When the elevation device ascends, the container 36 may be disposed at a higher position than the lower storage chamber 12.

Although the shape of the container 36 is not limited, the container 36 may have a shape corresponding to the size of the front space S1 and may have a predetermined height to prevent the stored food from spilling out when the elevation device 80 ascends.

The food or container 36 inside the lower drawer door 30 disposed at the lowest position may be more easily lifted and used through the above-described manipulation.

The lower drawer door 30 may be automatically inserted and withdrawn forward and backward by the draw-out motor 14, the pinion 141 provided in the cabinet 10, and the draw-out rack 34 provided on the bottom surface of the lower drawer door 30.

Also, the container inside the lower drawer door 30 may be elevated by the driving device 40 and the elevation device 80 provided in the lower drawer door 30.

Hereinafter, the lower drawer door 30 and an operation of the lower drawer door 30 will be described in more detail, and also, the lower drawer door 30 will be referred to as a drawer door or a door unless otherwise specified.

The implementations are not limited to the number and shape of the drawer doors and may be applied to all refrigerators having a door that is inserted and withdrawn in a drawer type into/from the lower storage chamber.

Figure 3:
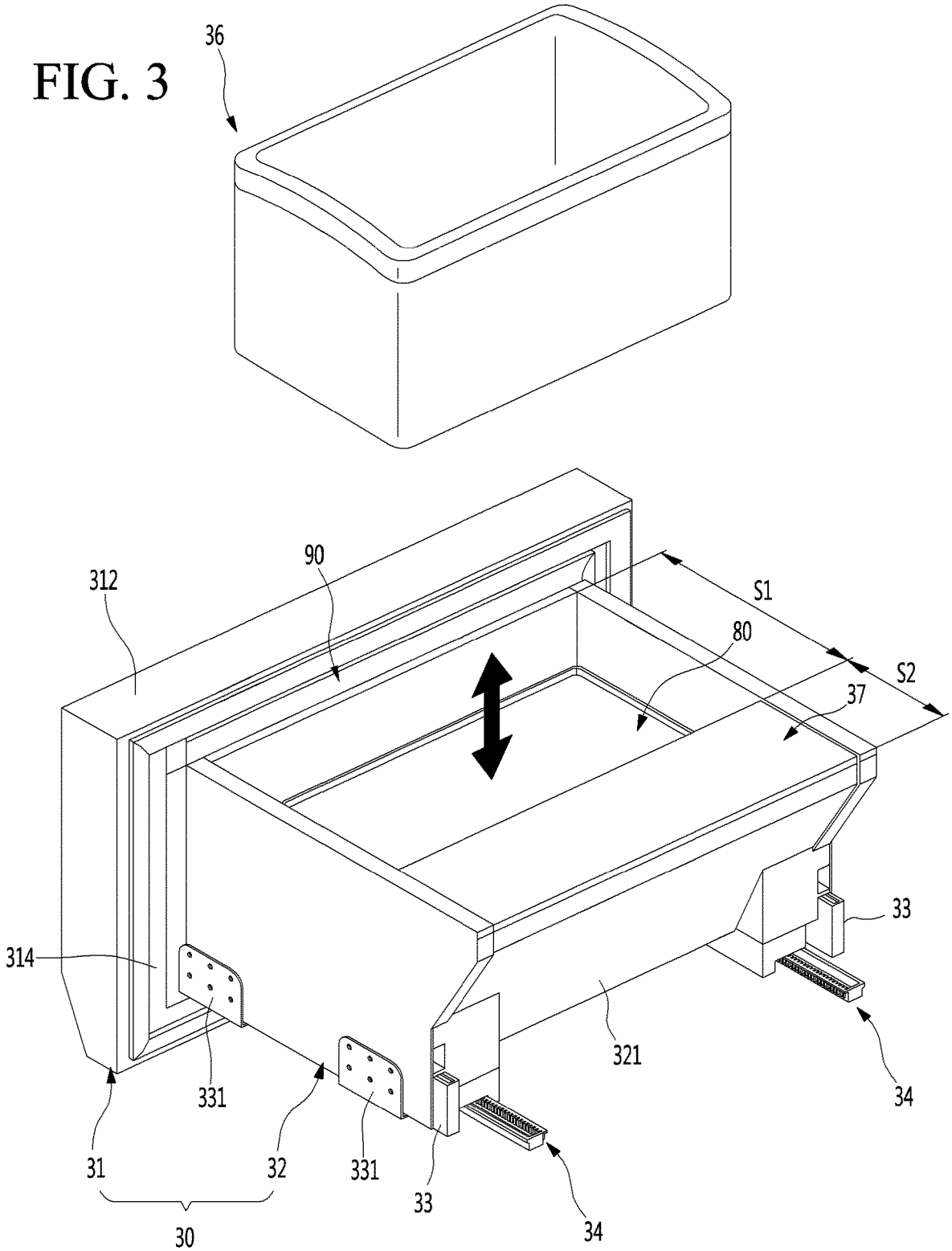
FIG. 3 is a perspective view illustrating a state in which a container of the drawer door is separated.
Figure 4:
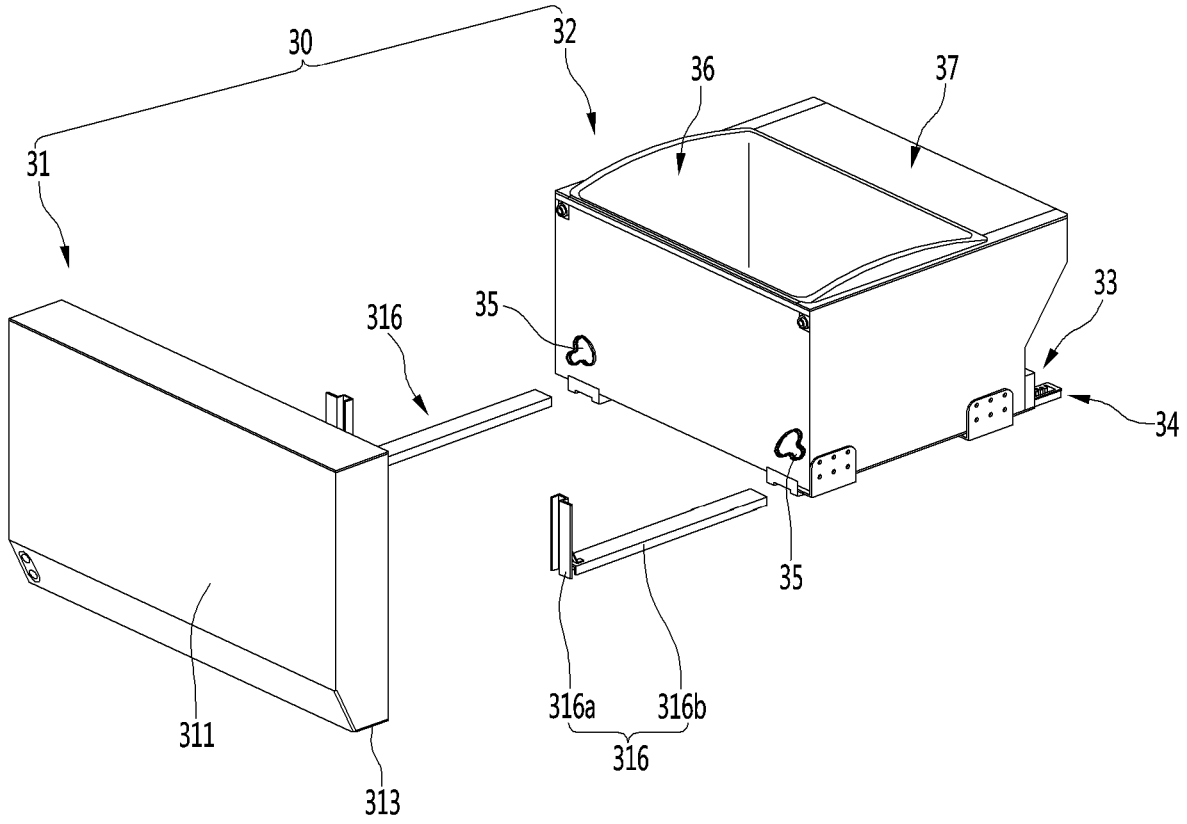
FIG. 4 is an exploded perspective view illustrating a state in which a drawer part of a drawer door and a door part are separated from each other when viewed from a front side.

FIG. 3 is a perspective view illustrating a state in which the container of the drawer door is separated. Also, FIG. 4 is an exploded perspective view illustrating a state in which the drawer part of the drawer door and the door part are separated from each other when viewed from a front side.

As illustrated in the drawings, the door 30 may include a door part 31 for opening and closing the storage chamber. The door 30 may also include a drawer part 32 coupled to a rear surface of the door part 31 and that is designed to be inserted and withdrawn together with the door part 31.

The door part 31 may be exposed to the outside of the cabinet 10 to define an outer appearance of the refrigerator 1, and the drawer part 32 may be disposed inside the cabinet 10 to define an storage chamber. Also, the door part 31 and the drawer part 32 may be coupled to each other and inserted and withdrawn in a forward/backward direction together with each other.

The drawer part 32 may be disposed on the rear surface of the door part 31 to define a space in which the food or container to be stored is accommodated. The inside of the drawer part 32 may provide an upwardly opened storage chamber, and an outer appearance of the drawer part 32 may be defined by a plurality of plates (see reference numerals 391, 392, and 395 in FIG. 14). Each of the plurality of plates 391, 392, and 395 may be made of a metal material and provided inside and outside the drawer part 32 such that the entire drawer part 32 is made of stainless steel. In some cases, a material having a texture of stainless steel may be used.

In the state in which the door 30 is inserted, a machine room 3, in which a compressor and a condenser for performing a refrigeration cycle are provided, may be disposed behind the door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the door 30 may be provided on each of both side surfaces of the drawer part 32. The door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multiple stages.

A rail bracket 331 may be provided on the draw-out rail 33, and the rail bracket 331 may extend from one side of the draw-out rail 33 to both sides of the drawer part 32. Also, the rail bracket 331 may be fixedly coupled to a sidewall surface inside the refrigerator. Thus, the drawer part 32, that is, the door 30, may be mounted to the cabinet 10 by the draw-out rails 33.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided at a lower ends of each of both sides of the drawer part 32 and may be called an under rail.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the door 30. That is, when an operation is inputted into the manipulation parts 22 and 301, the draw-out motor 14 may be driven to insert and withdraw the door 30 according to movement of the draw-out rack 34. Here, the door 30 may be stably inserted and withdrawn by the draw-out rail 33.

The draw-out rack 34 may not be provided on the drawer part 32. Here, the user may hold a side of the door part 31 to push and pull the door part 31 so that the door 30 is directly inserted and withdrawn.

The inside of the drawer part 32 may be divided into a front space S1 and a rear space S2. The elevation member 80 that is vertically elevated and a container seated on the elevation member 80 to be elevated together with the elevation member 80 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

Also, when the door 30 is withdrawn, the entire drawer part 32 may not be withdrawn to the outside of the storage chamber due to a limitation in draw-out distance of the door 30. That is, at least the front space S1 is withdrawn to the outside of the storage chamber, and the whole or a portion of the rear space S2 is disposed inside the storage chamber within the cabinet 10.

In such a structure, a draw-out distance of the door 30 may be limited by the draw-out rack 34 or the draw-out rail 33. As the draw-out distance becomes longer, the moment applied to the door 30 may become larger in the drawn-out state, and thus it can be difficult to maintain a stable state, thus resulting in possible deformation or damage of the draw-out rail 33 or the draw-out rack 34 may occur.

The elevation device 80 and the container 36 may be accommodated in the front space S1. While the elevation device is elevated, the food or container 36 seated on the elevation device 80 may be elevated together. Also, the elevation device 80 may be provided below the container 36, and the elevation device 80 may be covered by the container 36 when the container 36 is mounted. Thus, elements of the elevation device 80 may not be exposed to the outside.

A separate drawer cover 37 may be provided in the rear space S2. The front space S1 and the rear space S2 may be partitioned by the drawer cover 37. In a state in which the drawer cover 37 is mounted, a space in which front and top surfaces of the rear space S2 are covered and not be used may be not be exposed to the outside.

However, when the drawer cover 37 is separated, the user may access the rear space S2, and thus, food items may be easily accommodated in the rear space S2. To utilize the rear space S2, a separate pocket or a container corresponding to the shape of the rear space may be disposed in the rear space S2.

Also, the elevation device 80 inside the drawer part 32 may be easily separated and mounted to allow the utilization of the entire space inside the drawer part 32, and the elevation device 80 and the drawer cover 37 may be separated from each other to utilize the entire space of the drawer part 32.

The outer appearance of each of the inner and outer surfaces of the drawer part 32 may be defined by the separate plates 391, 392 and 395, which cover the components mounted on the drawer part 32, and thus, the outer and inner appearances may be seen to be neat. The plates 391, 392, and 395 may include a plurality of plates and may be made of stainless steel to provide a more luxurious and clean appearance.

As illustrated in the drawings, the door part 31 and the drawer part 32 of the door 30 may be may be separably coupled to each other. Thus, assembling workability and serviceability may be improved through the separable structure of the door part 31 and the drawer part 32.

A rear surface of the door part 31 and a front surface of the drawer part 32 may be coupled to each other. When the door part 31 and the drawer part 32 are coupled to each other, power for the elevation of the elevation device 80 may be provided. The driving device 40 for elevating the elevating device 80 may be disposed on the door part 31, and the door part 31 and the drawer part 32 may be selectively connected to each other.

In more detail, the driving part 40 provided in the door part 31 may be configured to receive power from the power source and to transmit the power to the elevation part 80.

Thus, it is possible to remove the door part 31 when the service of the driving part 40 is necessary and to, if necessary, simply replace just the door part 31.

The door part 31 and the drawer part 32 may be coupled by a pair of door frames 316 provided on both sides. The door frame 316 includes a door coupling part 316*a* extending upward and downward to be coupled to the door part 31 and a drawer coupling part 316*b* extending backward from a lower end of the door coupling portion 316*a*. The door coupling part 316*a* may be coupled to the door part 31 by a separate coupling member and may be coupled to one side of the door part 31 by a simple coupling structure. Also, the drawer coupling part 31*b* may be mounted on each of both sides of the drawer part 32 and be inserted and mounted in a state of being coupled to the draw-out rail 33. The drawer coupling part 316*b* and the draw-out rail 33 may be covered by the plate 391 mounted on the drawer part 32 and thus may not be exposed to the outside.

Also, a connecting assembly 70 may be provided on the rear surface of the door 30 so that the driving part 40 and the elevation are 80 are connected to each other when the door part and the drawer part 32 are coupled. A drawer opening 35 through which a part of the elevation device 80 is exposed may be defined in a position corresponding to the connecting assembly 70 on the front surface of the drawer part 32.

The door part 31 may be configured to substantially open and close the storage chamber of the cabinet 10 and to define the front surface of the refrigerator 1.

The door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, an insulation material 300 may be filled in the inside of the door part 31 between an outer case 311 and a door liner 314.

Hereinafter, a structure of the door part 31 of the door 30 will be described in more detail.

Figure 5:
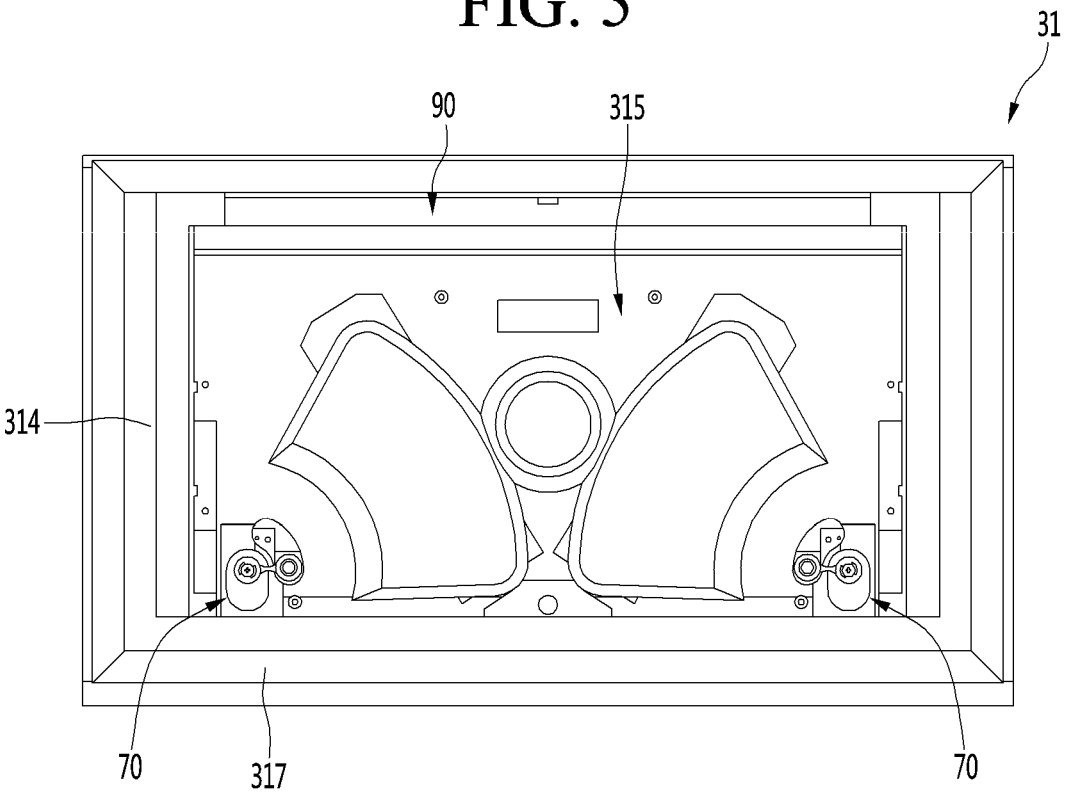
FIG. 5 is a view illustrating a rear surface of the door part.
Figure 6:
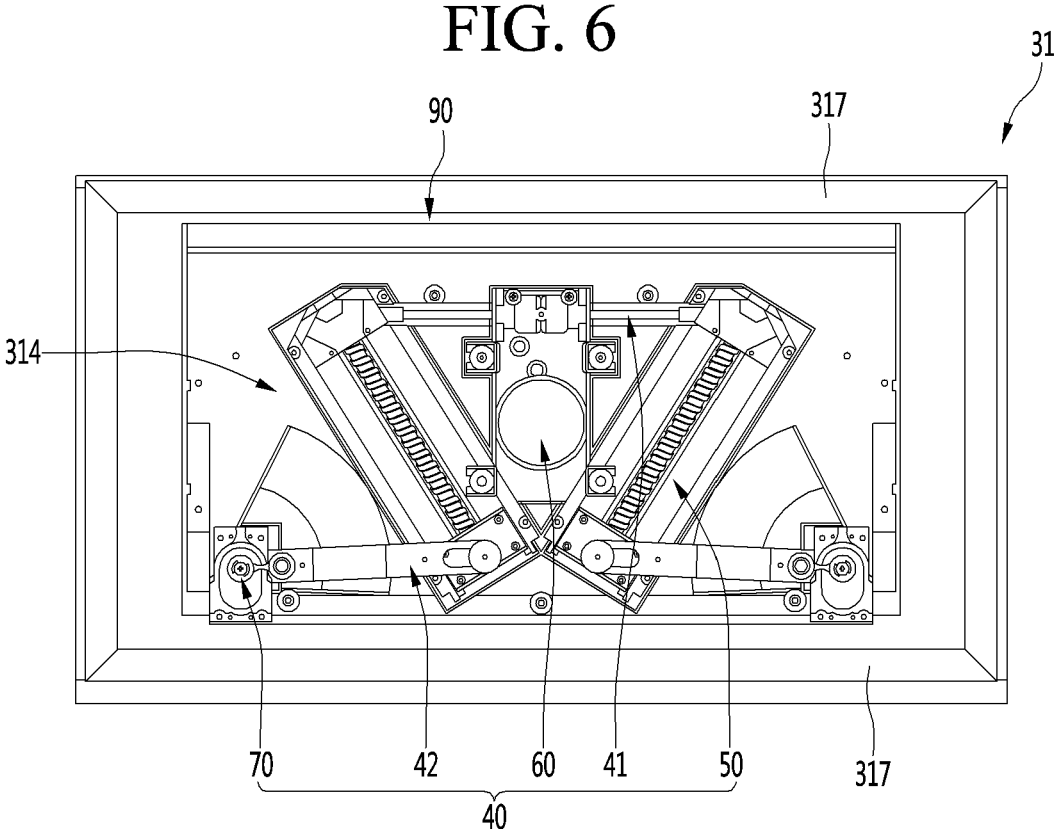
FIG. 6 is a rear view illustrating a state in which a door cover of the door part is removed.
Figure 7:
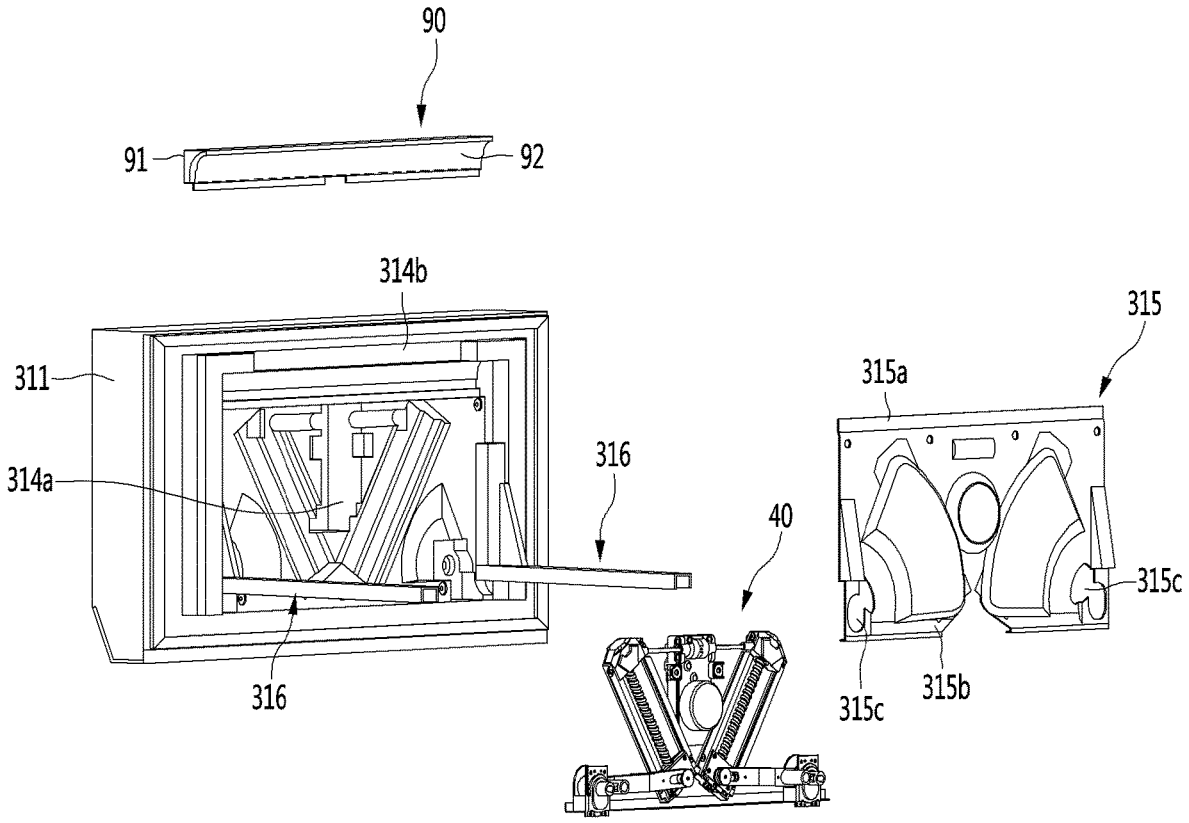
FIG. 7 is an exploded perspective view of the door part.

FIG. 5 is a view illustrating a rear surface of the door part. Also, FIG. 6 is a rear view illustrating a state in which a door cover of the door part is removed. Also, FIG. 7 is an exploded perspective view of the door part.

As illustrated in the drawings, a front surface of the door part 31 may be defined by the outer plate 311, and a rear surface may be defined by the door liner 314. Also, a driving device 40 for operating the elevation device 80 may be provided inside the door part 31. Although the driving device 40 may be disposed inside the door part 31, the driving device 40 but is not embedded in the insulation material 300 but is disposed inside a recessed space of the door liner 314. Then, the driving device 40 may be covered by the door cover 315 and thus may not be exposed to the outside.

In more detail, the insulating material 300 may be filled between the outer plate 311 and the door liner 314 to insulate the inside of the storage chamber 12. Also, the door liner 314 may have a door recess part 314*a* that is recessed inward. The door recess part 314*a* may have a shape corresponding to that of the driving device 40. Thus, the door recess part 314 may have a shape corresponding to that of each of the elements of the elevation device 80 so that the entire driving device 40 can be inserted into the internal space of the door 30.

Also, a lighting recess part 314*b* may be provided in the upper portion of the rear surface of the door part 31, i.e., the upper portion of the door liner 314. The lighting unit 90 may be mounted in the lighting recess part 314*b*. The lighting unit 90 may be disposed above an opened top surface of the drawer part 32 to emit light to the inside of the drawer part 32 at the front side of the drawer part 32, thereby illuminating the inside of the drawer part 32.

As illustrated, the lighting unit 90 may be elongated in the lateral direction from the left side to the right side of the rear surface of the door 30 and may be disposed at the uppermost position of the inner side regions of a gaskets 317 disposed along the rear surface of the door 30.

The driving device 40 may be mounted in the door recess part 314*a* disposed below the lighting unit. The driving device 40 may be covered by the door cover 315 in the state of being mounted in the door recess part 314*a*. The door cover 315 may be omitted in some cases. When the door cover 315 is omitted, the front surface of the drawer part 32 may cover the driving device 40.

The driving device 40 may be connected to the elevation device 80 provided in the drawer part 32 by the connecting assembly 70. Thus, power of the driving device 40 may be transmitted to the elevation device through the connecting assembly 70. Here, power having the same intensity may be transmitted to both sides of the elevation device 80 through the connecting assemblies 70 disposed on both sides at the same time. Thus, the elevation device 80 may ascend and descend in the horizontal state at both left and right sides without being tilted or biased to one side.

The door cover 315 defining a portion of an outer appearance of the rear surface of the door part 31 may be mounted on the rear surface of the door part 31. The door cover 315 may cover the driving device 40 mounted on the door part 31. The door cover 315 may have a plate shape to cover the driving device so that the door cover 315 is not exposed in the driving device 40 is mounted. Here, the door cover 315 may have a shape that protrudes or is recessed at a position corresponding to the driving device 40.

Also, the door cover 315 may be spaced apart from at least a portion of the door liner 314 in the state of being mounted on the rear surface of the door part 31. Thus, cool air may be supplied therein to cool the driving device.

Also, an upper end 315*a* of the door cover 315 may contact the door liner 314 to cover a portion of the lighting unit 90. Here, a portion of an upper portion of the lighting unit 90 may be exposed. Thus, a space in which light is emitted into the drawer part 32 may be secured.

Also, the upper end 315*a* of the door cover 315 may contact the lighting unit 90. Thus, when the cool air of the lower storage chamber 12 flows to the lighting unit 90, the cool air may flow along the door cover 315 via the lighting unit 90.

Also, a lower air guide 315*b* may be disposed on a lower end of the door cover 315. The lower air guide 315*b* may extend from a left side to a right side of the lower end of the door cover 315. Also, the lower air guide 315*b* may further protrude downward from the lower end of the drawer part 32 and also protrude to be rounded or inclined backward. Thus, the cool air flowing along the door cover 315 may be guided into a space between the bottom surface of the drawer part 32 and the lower storage chamber 12 along the lower air guide 315*b*.

A cover opening may be defined in one side of the door cover 315. The cover opening may be defined to be opened to the upper or lower portion of the door cover 315 so that the cool air flows along an inner surface of the door cover 315. A portion of the cool air flowing along the door cover 315 may be introduced into the space in which the driving device 40 is accommodated to more effectively cool the driving device 40. Alternatively, a door opening 315*c* through which the connecting assembly 70 is exposed may be included in the cover opening.

The door opening 315*c* may be defined in each of both left and right sides of the lower portion of the door cover 315. The door opening 315*c* may be defined so that a portion of the connecting assembly 70 passes through the door opening 315*e* to protrude from the rear surface of the door part 31. Also, the door opening 315*c* may have a corresponding shape at a position facing the drawer opening 35. Thus, a portion of the connecting assembly 70 exposed through the door opening 315*c* when the door part 31 and the drawer part 32 are coupled may be coupled to the elevation device 80 to transmit the power Also, a push part 741 of the connecting assembly 70 may be exposed through the door opening 315*c*. The user may manipulate the push part 741 exposed to the rear surface of the door part 31 to selectively couple or separate the driving device 40 to/from the elevation device 80.

A door gasket 317 may be provided along the rear surface of the door part 31. When the door 30 is closed, the door gasket 317 may contact the front surface of the cabinet 10 to provide an airtight seal.

Hereinafter, a structure of the lighting unit will be described in more detail.

Figure 8:
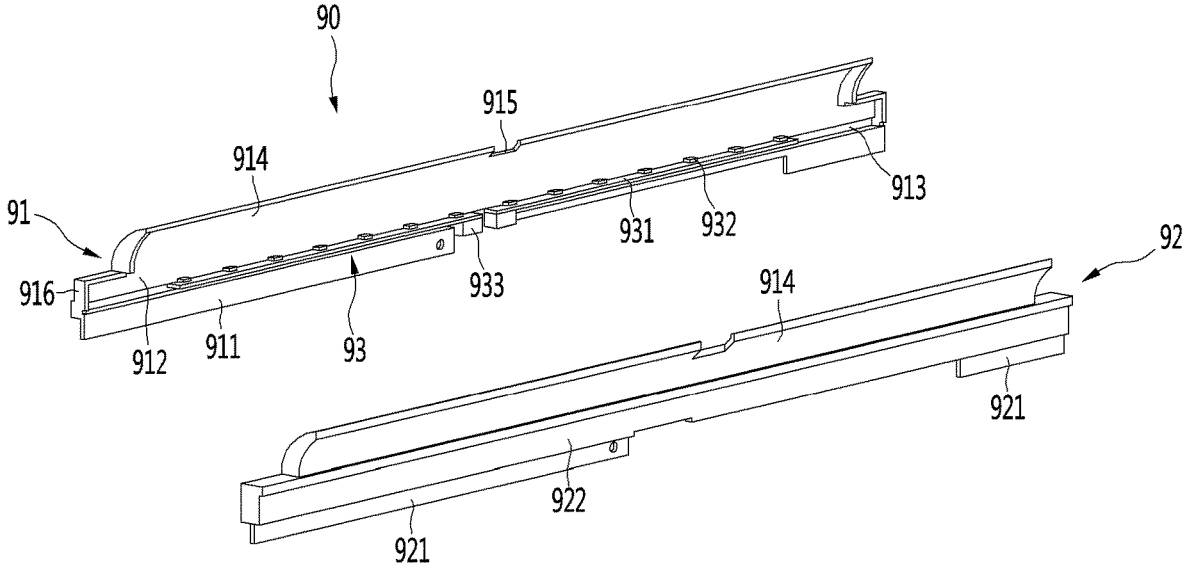
FIG. 8 is an exploded perspective view of a lighting unit according to an implementation.
Figure 9:
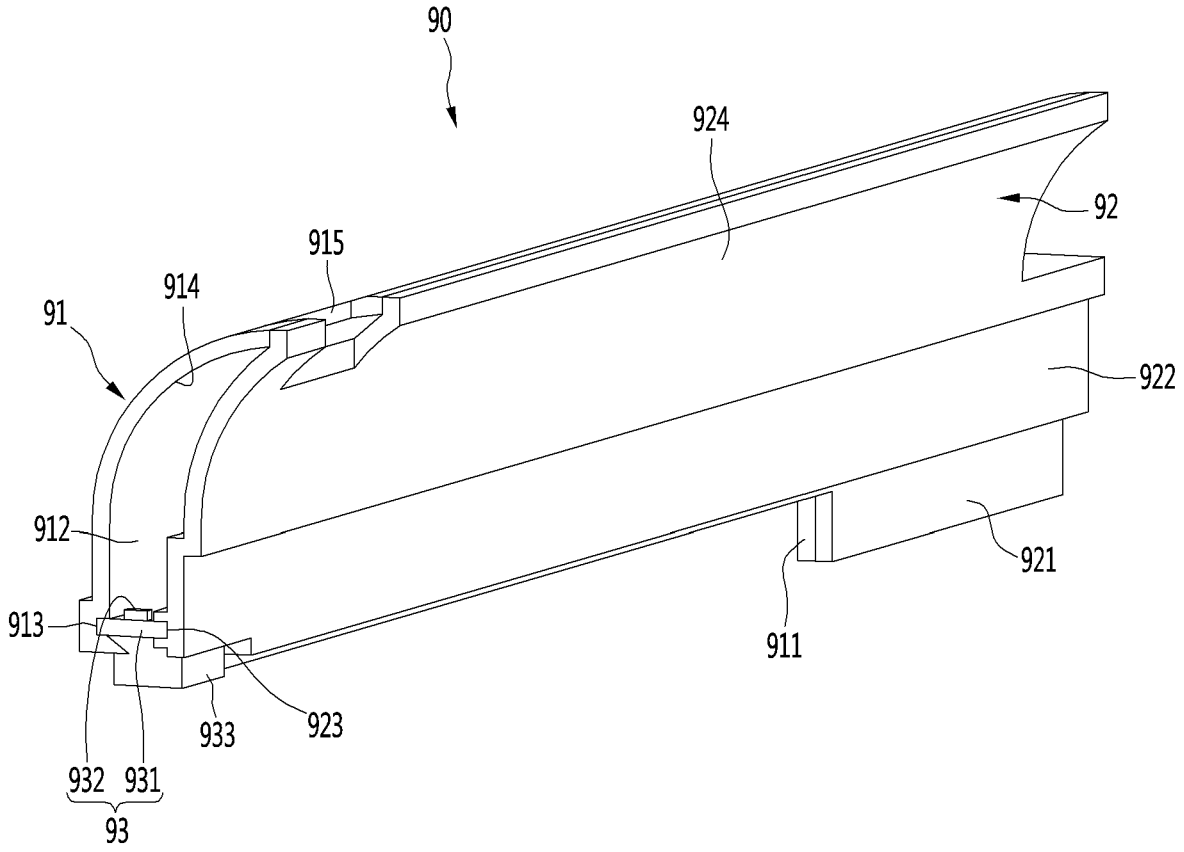
FIG. 9 is an cutaway perspective view of the lighting unit.
Figure 10:
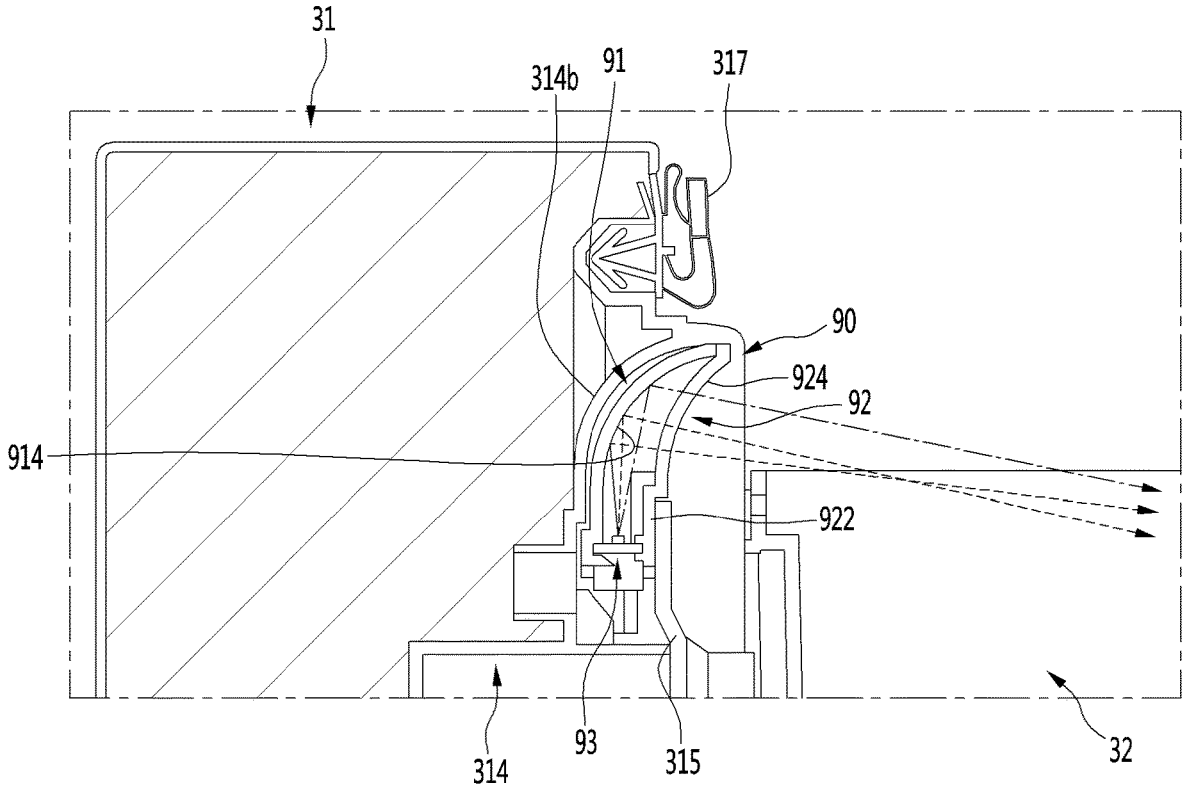
FIG. 10 is a view illustrating a state in which light is emitted when the lighting unit operates.
Figure 11:
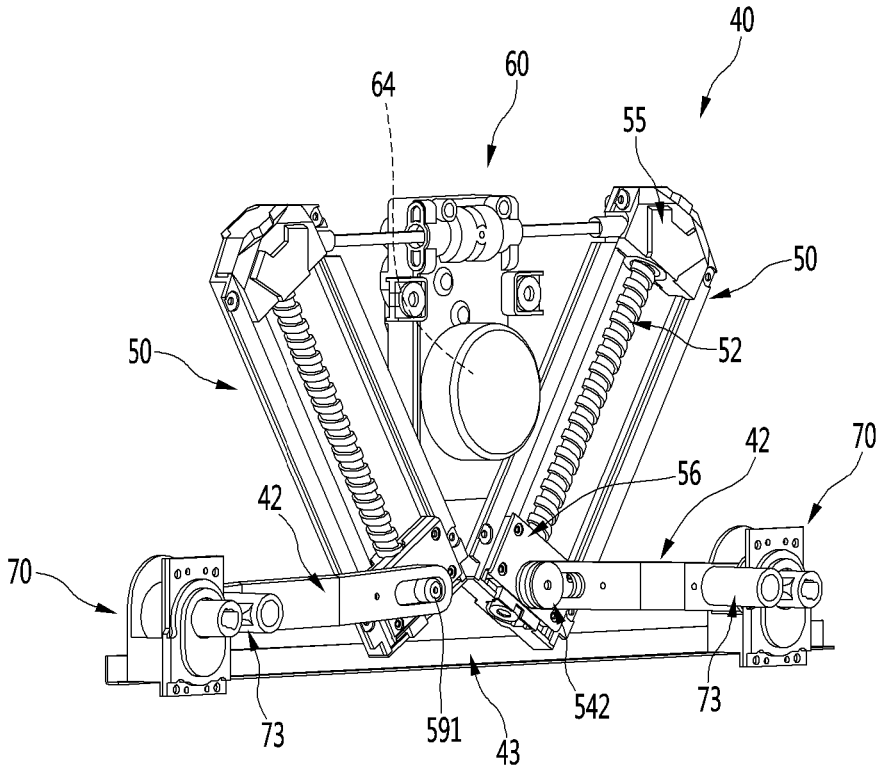
FIG. 11 is a perspective view of a driving device according to an implementation.

FIG. 8 is an exploded perspective view of the lighting unit according to an implementation. FIG. 9 is a cutaway perspective view of the lighting unit. Also, FIG. 10 is a view illustrating a state in which light is emitted when the lighting unit operates. Also, FIG. 11 is a perspective view of the driving device according to an implementation.

As illustrated in the drawings, the lighting unit 90 may be elongated along a longitudinal direction, and an outer surface of the lighting unit 90 may have a generally rounded in a vertical direction. Also, the lighting unit 90 may include a lighting case 91, a lighting cover 92, and a light emitting diode (LED) module 93. Other types of lighting modules may be used in alternative implementations.

In more detail, the lighting case 91 may be mounted to the door liner 314 and have a shape corresponding to that of the lighting recess part 314*b*. A case seating part 911 mounted in the lighting recess part 314*b* may extend from a lower end of the lighting case 91. A hole may be defined in the case seating part 911 so that the lighting unit 90 is coupled to the lighting recess part 314*b* or is mounted to be fixed to the rear surface of the door part 31 through screw coupling.

Also, an LED accommodation part 912 may be provided above the case seating part 911. The LED accommodation part 912 may be a space into which the LED module 93 is accommodated. The LED accommodation part 912 may extend from a left end to a right end of the lighting case 91 and have a predetermined width in a vertical direction. Also, a module mounting groove 913 may be defined in a lower end of the LED accommodation part 912. The module mounting groove 913 may be fixed so that an end of a substrate 931 having the LED module 93 may be inserted. Thus, in the state in which the LED module 93 is mounted in the LED accommodation part 912, the LED 932 may emit light toward an upper side.

In some implementations, a reflection part 914 may be disposed on an upper end of the case seating part 911. The reflection part 914 may correspond to a horizontal length of the drawer part 32, i.e., a length from the left end to the right end of the drawer part 32. Thus, the light emitted through the reflection part 914 may uniformly illuminate the inside of the drawer part 32.

The reflection part 914 may have a curved surface that is curved rearward such that it is gradually extended rearward from the rear surface of the door part 31 in an upward direction. The reflection part 914 may reflect the light emitted from the LED 932 to travel to the front side. To improve reflection efficiency of the LED 932, an inner surface of the reflection part 914 may be coated with a material having high reflectivity or be surface-treated. Alternatively, a film having the high reflectivity may be attached to the inner surface.

In some implementations, the reflection part 914 may have a curvature so that the light of the LED 932, which is emitted from the lower side is emitted toward the rear side, i.e., toward the inner surface of the drawer part 32. That is, the reflection part 914 may gradually protrude backward with respect to the lower end of the reflection part 914 and have a rounded shape.

Thus, the light reflected by the lower portion of the reflection part 914 may be emitted to a relatively rear side of the inside of the drawer part 32, and the light reflected by the upper portion of the reflection part 914 may be emitted to a relatively front side of the inside of the drawer part 32. Also, the LED module 93 may be disposed at a position that is close to the lower portion of the upper and lower portions of the reflection part 914.

A restriction groove 915 may be defined in one side of an upper end of the reflection part 914. The restriction groove 915 may be coupled to one side of the door liner 314. Thus, the lighting case 91 may be guided to be more precisely mounted at a fixed position.

In some implementations, a case edge 916 may be disposed on circumferences of the LED accommodation part 912 and the reflection part 914. The case edge 916 may be coupled to a circumference of the lighting cover 92 to define a space between the lighting case 91 and the lighting cover 92.

The LED module 93 may include a plurality of LEDs 932 and a substrate 931 on which the plurality of LEDs 932 are continuously disposed at predetermined intervals in a longitudinal direction. The substrate 831 may have a length that is equal to or slightly less than that of the reflection part 914 and be disposed to perpendicularly cross the rear surface of the door part 31 so that the light is emitted upward.

The substrate 931 may have a thickness that is enough to be inserted into the module mounting groove 923. Both ends of the substrate 931 may be inserted into module mounting grooves 913 and 923, which are respectively defined in the lighting case 91 and the lighting cover 92. The substrate 931 may have a width corresponding to that of a lower end of the case edge 916 and be mounted in a state of being accommodated in the space between the lighting case 91 and the lighting cover 92.

In some implementations, a connector 933 to which an electric wire transmitting control signals of the LEDs 932 and power is connected may be disposed at a center of the substrate 931. The connector 933 may protrude from a bottom surface of the substrate 931 and be exposed to the outside through a lower end of the lighting unit 90. Thus, in the state in which the lighting unit 90 is mounted on the rear surface of the door part 31, the electric wire may be connected through the connector 933.

The lighting cover 92 may be coupled to the lighting case 91. When the door light 90 is mounted, the lighting cover 92 may be exposed through the rear surface of the door part 31. The lighting cover 92 may be made of a transparent or semitransparent material so that the light reflected by the lighting case 91 is transmitted. Also, surface treatment, coating, or diffusion particles may be added so that the light emitted from the LED 932 is emitted in the form of surface light.

The lighting cover 92 may have a shape corresponding to the lighting case 91 as a whole. A cover seating part 921 corresponding to the case seating part 911 may be disposed on the lower end of the lighting cover 92. The cover seating part 921 and the case seating part 911 may overlap each other and be mounted to be coupled to the door liner 314 or mounted in a state in which the lighting cover 92 and the lighting case 91 are coupled to each other.

A cover extension part 922 may be disposed on an upper end of the cover seating part 921. The cover extension part 922 may have a size corresponding to that of the LED accommodation part 912 and covers the LED accommodation part 912 at a rear side. Also, a module mounting groove 923 may be defined in an inner surface of the cover extension part 922. The module mounting groove 923 may be defined in a position facing the module mounting groove 913 defined in the LED accommodation part 912. Thus, both the ends of the substrate 931 may be fixed by the module mounting grooves 913 and 923.

In some implementations, a cover guide part 924 may be disposed on an upper end of the cover seating part 921. The cover guide part 924 may be configured to guide the cool air flowing in the lower storage chamber 12 to the lower side and have a predetermined curvature.

The cover guide part 924 may be disposed at a position facing the reflection part 914 and have a size corresponding to that of the reflection part 914. The cover guide part 924 may have a curvature greater than that of the reflection part 914. Thus, the cool air flowing from the rear side to the rear surface of the door part 31, i.e., the lighting unit 90 may be guided to flow downward through the cover guide part 924. The cover guide part 924 may be disposed above the drawer part 32. Also, since the cover guide part 924 is disposed above a lower air guide that will be described below, the cover guide part 924 may be called an upper air guide.

A lower end of the cover guide part 924 and an upper end of the cover extension part 922 may be stepped with respect to each other. The cover extension part 922 may be disposed in front of the lower end of the cover guide part 924, and the stepped portion between the cover extension part 922 and the cover guide part 924 may have a height corresponding to the thickness of the door cover 315.

In detail, the upper end of the door cover 315 may be seated on the cover extension part 922, and the upper end of the cover extension part 922 may contact the cover guide part 924. Thus, the air guided downward along the cover guide part 924 may smoothly flow downward along the door cover 315.

In some implementations, the door cover 315 may be made of an opaque material and be seated on the cover extension part 922 to cover the LED module 93 provided inside the lighting unit 90. Thus, the light emitted from the LED module 93 may be shielded by the upper end of the door cover 315 so as not to be directly emitted to the inside of the refrigerator. Also, the light reflected by the reflective part 914 may illuminate the inside of the drawer part 32 in the form of surface light.

Also, the upper end of the cover guide part 924 may be higher than the upper end of the drawer part 32. Thus, when the air flowing to passing through the upper side of the drawer part 32 flows toward the cover guide part 924, the air may flow to the cover guide part 924 without being affected by other elements.

Also, the outlet 123*b* provided in the area wall of the lower storage chamber 12 may be disposed at a height corresponding to the cover guide part 924. Thus, the air discharged through the outlet 123*b* may completely flow the cover guide part 924.

Also, the rear surface of the door part 31, i.e., the door cover 315 and the front surface of the drawer part 32 may be spaced apart from each other. Thus, the cool air guided through the cover guide part 924 may completely flow between the rear surface of the door part 31 and the front surface of the drawer part 32.

A cover inlet that is spaced apart from the lighting unit 90 or opened to allow a portion of the cool air to flow to the inside of the driving device mounting part 314*a* that is covered by the door cover 315 may be provided in the upper end of the door cover 315. Also, a cover outlet may be provided in the lower end of the door cover 315 so that the cool air guided by the cover guide part 924 directly cools the driving device 40 and then flows to the lower side of the drawer part 32. The cover outlet may be the door opening 315*c*.

Hereinafter, features of the driving device 40 will now be described in more detail with reference to the accompanying drawings.

Figure 12:
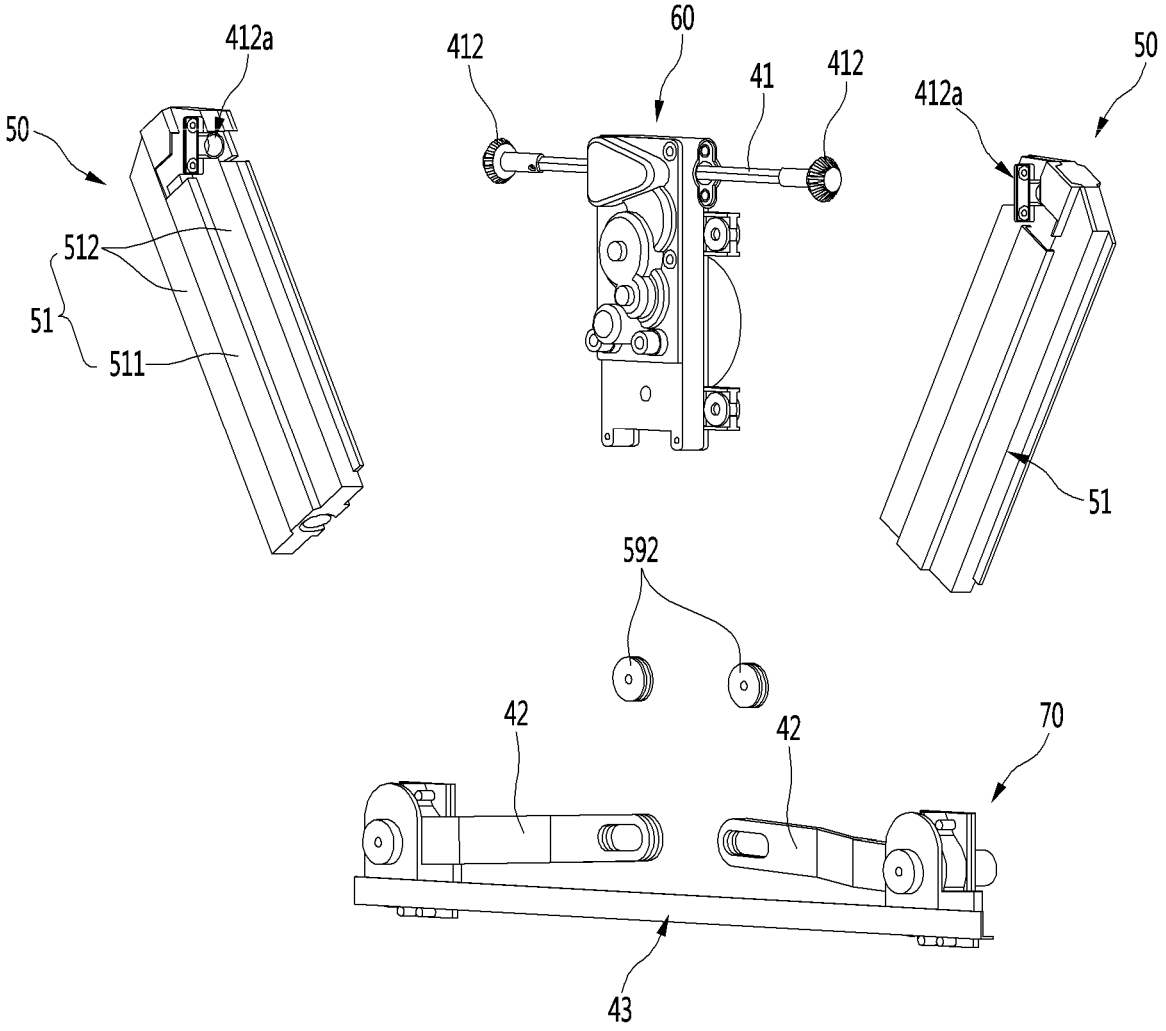
FIG. 12 is an exploded perspective view of the driving device.

FIG. 11 is a perspective view of the driving device according to an implementation. Also, FIG. 12 is an exploded perspective view of the driving device.

As illustrated in the drawings, the driving device 40 may include a motor assembly 60, a screw assembly 50 disposed on each of both sides of the motor assembly 60 and connected by a shaft 41, a lever 42 connected to the screw assembly 50, and the connecting assembly 70.

In detail, the motor assembly 60 may be disposed at a center of each of the left and right sides of the door part 31. Also, the driving device 40 may provide the power for elevating the elevating device 80. The driving device 40 may allow both the screw assemblies 50 and the lever 42 to operate by the motor assembly including one driving motor 64.

Particularly, the motor assembly 60 may adjust magnitude of the decelerated and transmitted force through a combination of the plurality of gears. Also, a shaft 41 passing through the motor assembly 60 from the left to the right, i.e., in a horizontal direction may be disposed on an upper end of the motor assembly 60, and the plurality of gears may be combined in the motor assembly 60 for rotation of the shaft 41.

Also, the motor assembly 60 may have a structure in which the driving motor 64 and the gears are arranged vertically to minimize a space recessed when the motor assembly 60 is mounted on the door part 31, in particular, a width in the left and right direction is widened, and a thickness in the front and rear direction is minimized. Also, the driving motor 64 of the motor assembly 60 may protrude toward the drawer part 32 to minimize a depth of the door part 31 to secure insulation performance.

The shaft 41 may pass through the motor assembly 60 in the transverse direction and be coupled to the screw assembly 50 disposed at both sides of the motor assembly 60 so that the power of the motor assembly 60 is simultaneously to the screw assembly (50). Thus, the shaft 41 may be called a power transmission member.

For this, the shaft 41 may have a length such that both ends of the shaft 41 pass through the motor assembly 60 and are inserted into the screw assembly 50. Also, a shaft driving gear 411 may be provided at a center of the shaft 41. The shaft driving gear 411 may be coupled to the gears in the motor assembly 60 to rotate. Also, a shaft gear 412 may be disposed on each of both ends of the shaft 41. The shaft gear 412 may have a structure that is coupled to the screw assembly 50. The shaft gears 412 may have the same structure so that the same rotation force is applied to the shaft gears 412. The screw assembly 50 may be transferred to the screw assembly 50 so that the screw assembly 50 operates simultaneously.

The screw assemblies 50 may be disposed on both sides of the motor assembly 60. The upper end of the screw assembly 50 may be connected to the shaft 41 and also be gear-coupled to the shaft gear 412 to transmit the power so that the screw 52 rotates. A screw gear having a bevel gear shape gear-coupled to the shaft gear 412 may be further disposed on the screw 52.

When the screw 52 rotates, a screw holder 56 may move along the screw 52. Also, the lever 42 may be coupled to the screw holder 56 to allow the lever 42 to rotate according to the movement of the screw holder 56.

For this, the upper end of the screw assembly 50 may be oriented outward, and the lower end of the screw assembly 50 may be inclined inward. Here, the screw assemblies 50 on both sides may be symmetrical to each other with respect to the motor assembly 60. Thus, the motor assembly 60 may be disposed between the screw assemblies 50 located on both sides of the screw assembly 50. The screw assembly 50 disposed on both sides of the motor assembly 60 may be provided so that a distance between the screw assemblies 50 gradually increases from the upper end to the lower end.

The screws 52 provided in the screw assembly 50 may be arranged in the same direction as the screw assembly 50, and extension lines of the screws 52 on both the left and right sides may cross each other. Also, the screw holder 56 may move along the screw 52 according to the rotation of the screw 52, and the lever 42 connected to the screw holder 56 may rotate along the connecting assembly 70. The screw assembly 50, the lever 42, and the connecting assembly 70 may be symmetrical to each other so that the lever 42 simultaneously rotates at the same angle as the screw assembly 50 is driven.

The lever 42 may connect the screw holder 56 to the connecting assembly 70. Thus, both ends of the lever 42 may be rotatably coupled to the screw holder 56 and the connecting assembly 70, respectively. Thus, when the screw holder 56 linearly moves, the lever 42 may be rotatable about the connecting assembly 70.

The connection assemblies 70 disposed on both the left and right sides may be connected to each other by a connector bracket 43, and the connecting assembly 70 may be firmly supported on the door part 31 to effectively transmit the rotation force to the elevation device 80.

Figure 13:
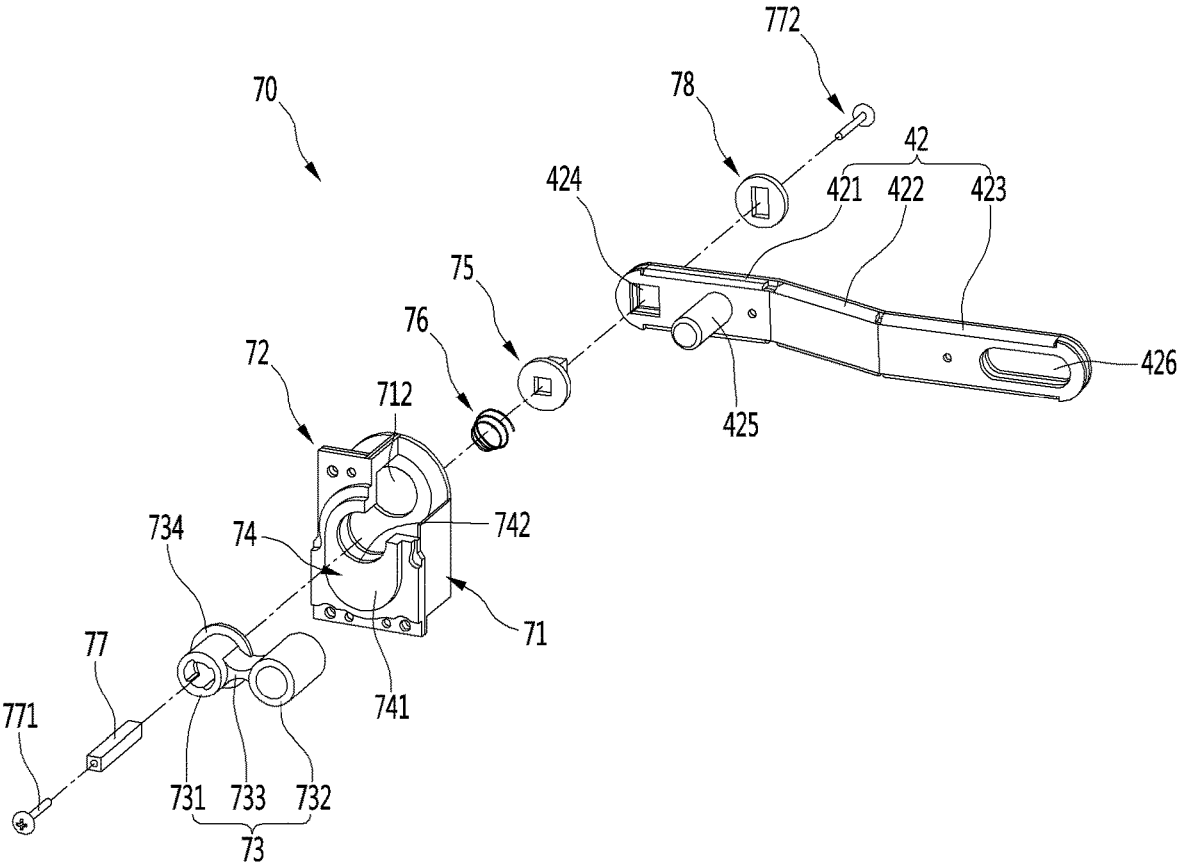
FIG. 13 is an exploded perspective illustrating a coupling structure of a connecting assembly, which is one component of the driving device, and a lever.

FIG. 13 is an exploded perspective illustrating a coupling structure of a connecting assembly, which is one component of the driving device, and a lever.

As illustrated in the drawing, the lever 42 may be configured to connect the screw assembly 50 to the connecting assembly 70.

In details of the structure of the lever 42, the lever 42 may be provided in a rod or bar shape having a predetermined width and may extend from the rotation axis of the connecting assembly 70 to the holder protrusion 591 of the screw assembly 50.

In detail, the lever 42 may include a first extension part 421 connected to the connecting assembly, a second extension part 423 connected to the screw holder 56, and an intermediate portion 422 connecting the first extension part 421 to the second extension part 423.

The first extension part 421 and the second extension part 423 may be disposed parallel to each other, and the intermediate portion 422 may have an inclination. Also, the first extension part 421 may be further backward than the second extension part 423 by the inclination of the intermediate part 422.

The lever 42 may not be deformed or damaged even if a large amount of force is applied to the lever 42 due to the structure and shape of the bent lever 42. Also, the lever 42 may be made of a metal material to realize the stable power transmission even when the elevation device 80 on which a heavy food is seated is elevated.

Also, the inclination of the intermediate portion 422 may allow the lever 42 to be connected between the connecting assembly 70 disposed relatively backward and the screw holder 56 disposed relatively forward.

A first lever hole 424 may be defined in the first extension part 421 to be connected to the lever fixing member 75 of the connecting assembly 70. The first lever hole 424 may be formed in a polygonal shape corresponding to one side of the lever fixing member 75 and may be opened in a rectangular shape as illustrated in the drawing. The lever fixing member 75 may also rotate together when the lever 42 rotates.

Also, the lever protrusion 425 may be disposed on the first extension part 421. The lever protrusion 425 may be spaced apart from the first lever hole 424 and disposed toward the intermediate part 422. The lever protrusion 425 may be configured to be coupled to the connection member 73 of the connecting assembly 70. That is, the rotation force of the lever 42 may be transmitted to the connecting assembly 70 by the lever protrusion 425 together with the first lever hole 424. Furthermore, the rotation force may be transmitted to the elevation device 80 to elevate the elevation device 80.

Also, a second lever hole 426 through which the holder protrusion 591 of the screw holder 56 is inserted may be defined in the second extension part 423. The second lever hole 426 may have a size corresponding to the holder protrusion 591 and also may have a long hole shape in the extension direction of the second extension part 423 so that the holder protrusion 591 move as the screw holder 56 move vertically. Thus, the holder protrusion 591 may be disposed on the left end of the second lever hole 426 in a state in which the screw holder 56 is disposed at the lowest position, and as the screw holder 56 move upward, the protrusion 591 moves to the right side of the second lever hole 426 so that the lever 42 rotates.

The connecting assembly 70 may be provided at one end of the lever 42, i.e., at a position corresponding to the first extension part 421. A connection member 73 for connecting the lever 42 to the elevation device 80 may be rotatably mounted on the inside of the connecting assembly 70.

The connection member 73 may be coupled to the lever fixing member 75 by the fixing shaft 77 and thus may rotate together with the rotation of the lever 42. Also, the connection member 73 may be connected to the lever protrusion 425 and the scissors protrusion 841*b* to transmit greater force to the elevation device 80, and thus, the elevation device 80 may be more effectively lifted. Thus, the elevation device 80 in the state in which the food is seated sufficiently while using only one of the drive motors 64 may be elevated, and a compact configuration may be realized.

The connecting assembly 70 may have an outer appearance defined by the connection case 71 and the connection cover 72, and the lever fixing member 75 and the connection member 73 may be mounted on the connection case 71.

The connecting assembly 70 may include the connection case 71, the connection cover 72, and the connection member 73, the push member 74, the lever fixing member 75, and the elastic member 76.

In detail, the connection case 71 may be opened on one side and includes a space for accommodating the lever fixing member 75, the connection member 73, the push member 74, and a portion of the lever 42. Also, a through-hole 712 may be defined in the space. An external fixing member 78 may be provided on the outer surface of the connection case 71 corresponding to the through-hole 712.

Also, the lever fixing member 75 may be accommodated in the space inside the connection case 71 and define a surface capable of supporting one end of the elastic member 76. Also, A first lever hole 424 of the lever 42 and the through-hole 712 may extend to be sequentially penetrated through a center of the lever fixing member 75 to allow the external fixing member 78 to be inserted therein.

The fixing shaft 77 may pass through the first connection part 731 of the connection member 73 and then be inserted into the lever fixing member 75. Also, coupling members 771 and 772 may be coupled to both ends of the fixing shaft 77, respectively. The lever fixing member 75, the external fixing member 78, and the connection member 73 may be coupled to the fixing shaft 77 through the coupling of the coupling members 771 and 772. Thus, when the lever fixing member 75 rotates by the rotation of the lever 42, the connection member 73 connected by the fixing shaft 77 may also rotate together.

The elastic member 76 may be provided between the connection member 73 and the lever fixing member 75. The elastic member 76 may be compressed when the connection member 73 moves. In detail, the elastic member 76 may have a coil spring structure and have one end supported by the lever fixing member 75 and the other end supported by the connection support part 734 of the connection member 73.

The connection member 73 may move in the front-rear direction within the space of the connection case 71. Here, the connection member 73 may have a structure that is inserted into or protrudes to the space by the guide of the fixing shaft 77.

In details of the structure of the connection member 73, the connection member 73 may include a first connection part 731 which passes through the fixing shaft 77 and is concentric with the rotation axis of the lever 42, a second connection part 731 which is spaced from the first connection part 731 and into which the lever protrusion 425 is inserted, and a connection part 733 connecting the first connection part 731 to the second connection part 732.

The first connection part 731 may have a hollow cylindrical shape. Also, the rotation shaft 841*a* of the elevation device 80 may be inserted into the first connection part to rotate together with the rotation shaft 841*a* of the elevation device 80.

Also, a connection support part 734 protruding outward by a predetermined width may be disposed on one side of the first connection portion 731. The end of the elastic member 76 may contact the connection support part 734, and the end of the first connection part 731 may contact the connection support part 734. The connection support part 734 may protrude outward to support one end of the elastic member 76, and one end of the first connection part 731 may be inserted into the elastic member 76 to prevent the elastic member 76 from being separated.

The connection support part 734 may be larger than the size of the through-hole 742 defined in the push member 74 to maintain the state in which the connection support part 734 is in close contact with the rear surface of the push member 74. Thus, the connection support part 734 and the push member 74 may move together when the push member 74 is pressed or when the elastic member 76 returns to the initial position.

The second connection part 732 may be disposed at a position spaced apart from the first connection part 731 by the connection member 73. The second connection part 732 may have a cylindrical shape that is penetrated in the front and rear direction. The lever protrusion 425 may be inserted into one side of the second connection part 732, and the scissors protrusion 841*b* of the elevation device 80 may be inserted into the other side of the second connection part 732. Thus, the second connection part 732 may rotate together with the scissors protrusion 841*a* and the lever protrusion 425 when the elevation device 80 operates.

The connection part 733 may be disposed so that the rotating shaft 841*a* and the scissors protrusion 841*b* of the elevation device 80 are respectively inserted into the first connection part 731 and the second connection part 732. As the second connection part 732 move farther away from the first connection part 731, the elevation device 80 may be easily elevated. However, when the first connection part 731 and the second connection part 732 are spaced a set distance or more from each other, the moving trajectory of the lever protrusion 425 and the scissors protrusion 841*b*, which are inserted into the second connection part 732, may extend up to a high height on the rear surface of the door part 31 and the front surface of the drawer part. Thus, the opened trajectory may be exposed to deteriorate the outer appearance. Thus, The position of the second connection part 732 may be determined by the length of the connection part 733. Also, the second connection part 732 may be disposed at a height at which the rotation trajectory is not exposed, i.e., a position higher than the upper end of the elevation device 80.

The push member 74 may be provided inside the connection device case 71 and may be exposed through the opening 721 of the connecting cover 72 so that the push member 68 is pressed by the user. The push member 74 may include a push part 741 that is exposed through the opening 721 of the connecting cover 72.

A through-hole 742 through which the first connection part 731 passes may be defined in the push part 741. The through-hole 742 may be larger than the outer diameter of the first connection part 731 and slightly smaller than the outer diameter of the connection support part 734. Thus, when the push member 741 may be pushed to move the push member 74, the first connection member 73 contacting the push member 74 may also move together to selectively connect the connection member 73 to the elevation device 80.

The connecting cover 72 may be mounted on the opened front side of the connecting case 71, and an opening 721 may be defined to expose the push part 741. The connecting cover 72 may be firmly fixed to the connecting case 71 by the coupling member. Thus, the configuration of the connecting case 71 may be maintained in the mounted state.

The connecting case 71, the push member 74, and a portion of the connecting cover 72 may be opened by cutting the connection member 73 by a rotational trajectory. Thus, the connection member 73 may be prevented from interfering with the connecting case 71, the push member 74, and the connecting cover 72 when the connection member 73 rotates.

In this structure, the user may manipulate the push member 74 of the connecting assembly 70 to selectively couple and separate the connecting assembly 70 to and from the elevation device 80.

Hereinafter, a structure of the drawer part 32 coupled to the door part 31 will now be described in more detail with reference to the accompanying drawings.

Figure 14:
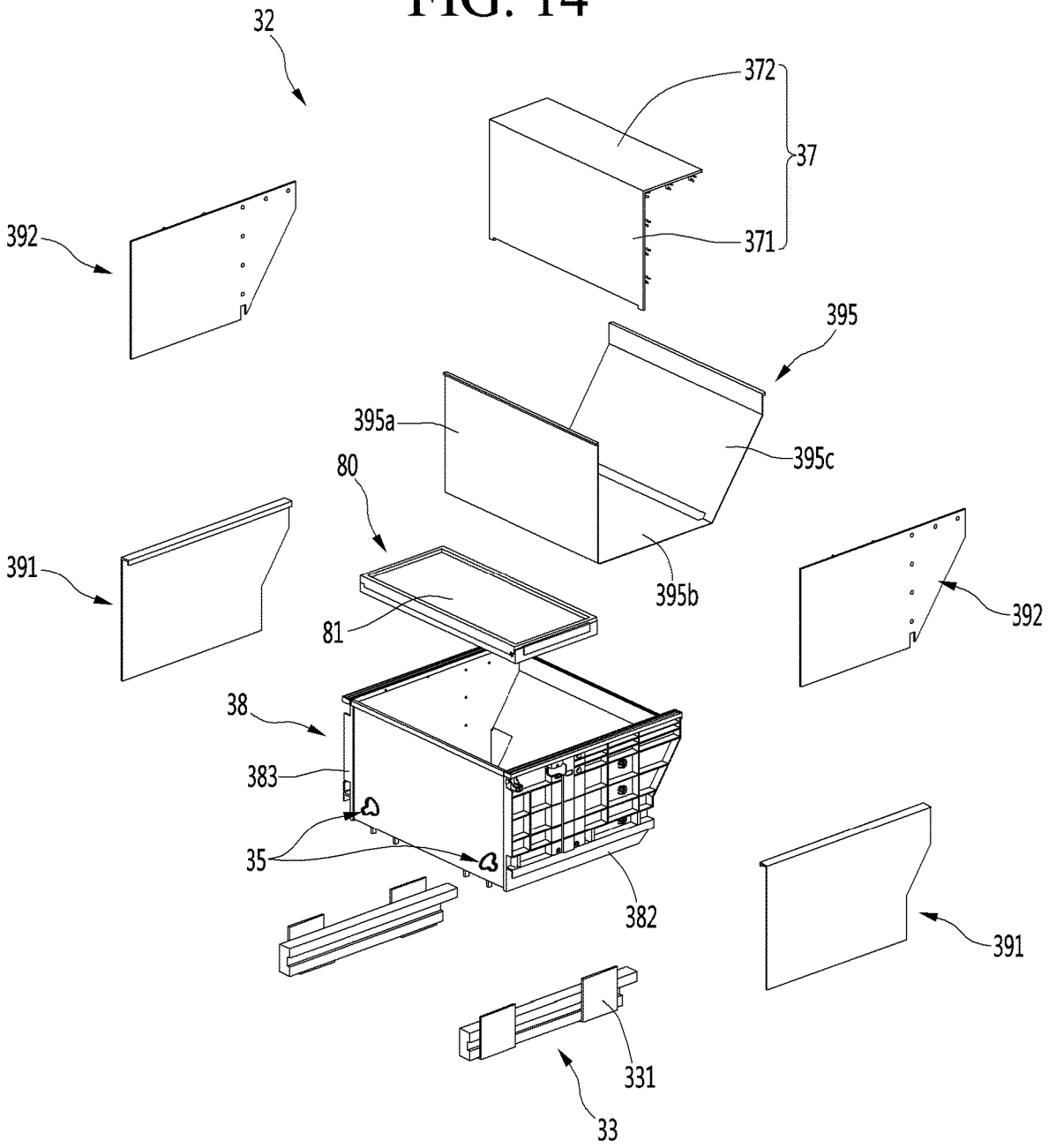
FIG. 14 is an exploded perspective view of a drawer part.

FIG. 14 is an exploded perspective view of the drawer part.

As illustrated in the drawings, the drawer part 32 may include a drawer body 38 defining an entire shape of the drawer part 32, an elevation device 80 provided in the drawer body 38 to elevate the container and food, and a plurality of plates 391, 392, and 393 defining an outer appearance of the drawer part 32.

In more detail, the drawer body 38 may be injection-molded by using a plastic material and define an entire shape of the drawer part 32. The drawer body 38 may have a basket shape having an opened top surface to define a food storage chamber therein. An inclined surface 321 may be disposed on a rear surface of the drawer body 38. Thus, an interference with the machine room 3 may not occur.

The door frames 316 may be mounted on both sides of the drawer part 32. The door frame 316 may be coupled to the lower frame of each of both sides of the bottom surface or both left and right surfaces of the drawer part 32. In the state in which the door frame 316 and the drawer part 32 are coupled to each other, the drawer part 32 and the door part 31 may be integrally coupled to be inserted and withdrawn.

The door frame 316 may be separated from the drawer part 32, and then the connecting assembly 70 may operate to separate the door part 31 from the drawer part 32 in order to separate the door part 31 from the drawer part 32. The door frame 316 and the drawer part 32 may be coupled to each other by a separate coupling member or a coupling structure between the door frame 316 and the drawer unit 32.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion is disposed in the storage chamber. Also, the draw-out rack 34 may be coupled to a pinion gear 141 disposed on the bottom surface of the storage chamber. Thus, when the draw-out motor 14 is driven, the pinion gear 141 may rotate to allow the draw-out rack 34 to move, and the door 30 may be inserted and withdrawn.

The door 30 may not be automatically inserted and withdrawn. That is, the user may push or pull the door 30 to be inserted and withdrawn. Here, the draw-out rack 34 may be omitted, and thus, the insertion and withdrawal may be performed through only the draw-out rail 33.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated. The draw-out rail 33 may be a rail that extends in multistage. The draw-out rail 33 may have one end fixed to the storage chamber inside the cabinet 10 and the other end fixed to the rail mounting part 382 to more stably realize insertion and the withdrawal of the door 30.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, features such as the door frame 316 and the draw-out rail 33, which are mounted on both the sides of the drawer body 38, may not be exposed to the outside.

A plurality of reinforcement ribs 384 may cross each other in vertical and horizontal directions on both outer surfaces of the drawer body 38. The reinforcement ribs 384 may reinforce the strength of the drawer body 38 itself so that the drawer body 38 is more rigidly shaped relative to the weight of the door, which increases by providing the driving device and the elevation. Also, the reinforcement ribs 384 may support the outer side plates 391 mounted on both side surfaces, and thus the outer appearance of the drawer part 32 may be firmly maintained.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

The inner plate 395 may include a front surface part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* of the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal. Thus, the storage chamber within the drawer part 32 may have a metal texture on the whole, and the foods accommodated in the drawer part 32 may be more uniformly cooled and thus stored at a low temperature in the more uniform region. In addition, excellent cooling performance and storage performance that is also visually appealing may be provided to the user as a result.

The drawer cover 37 may include a cover front part 371 that partitions the inside of the drawer body 38 into a front space S1 and a rear space S2 and a cover top surface part 372 bent from an upper end of the cover front surface part 371 to cover a top surface of the rear space S2.

That is, when the drawer cover 37 is mounted, only the front space S1, in which the elevation device 80 is disposed, may be exposed in the drawer body 38, and the rear space S2 may be covered by the drawer cover 37.

The elevation 80 may be disposed in the drawer body 38. The elevation device 80 may be connected to the connecting assembly 70 and may be vertically movable. The left and right sides of the elevation device 80 may be elevated uniformly.

A drawer opening 35 may be defined in the lower part of the front surface of the drawer part 32 for coupling the elevation device 80 to the connecting assembly 70. The drawer opening 35 may provide a passage through which the connection member 73 is inserted to be coupled to the elevation device. Also, the drawer opening 35 may have an opening shape along the rotation path of the connection member 73 when the connection member 73 rotates to allow the connection member 73 to rotate, and thus, the stable rotation may be achieved without the interference.

The elevation device 80 may be provided as a scissors type so that the elevation device is folded in a descending state and unfolded in an ascending state. Thus, the container or food seated on the upper surface may be elevated.

The elevation device 80 may be provided with a support plate 81, and the support plate 81 may provide a seating surface on which the container 36 or food is seated.

Figure 15:
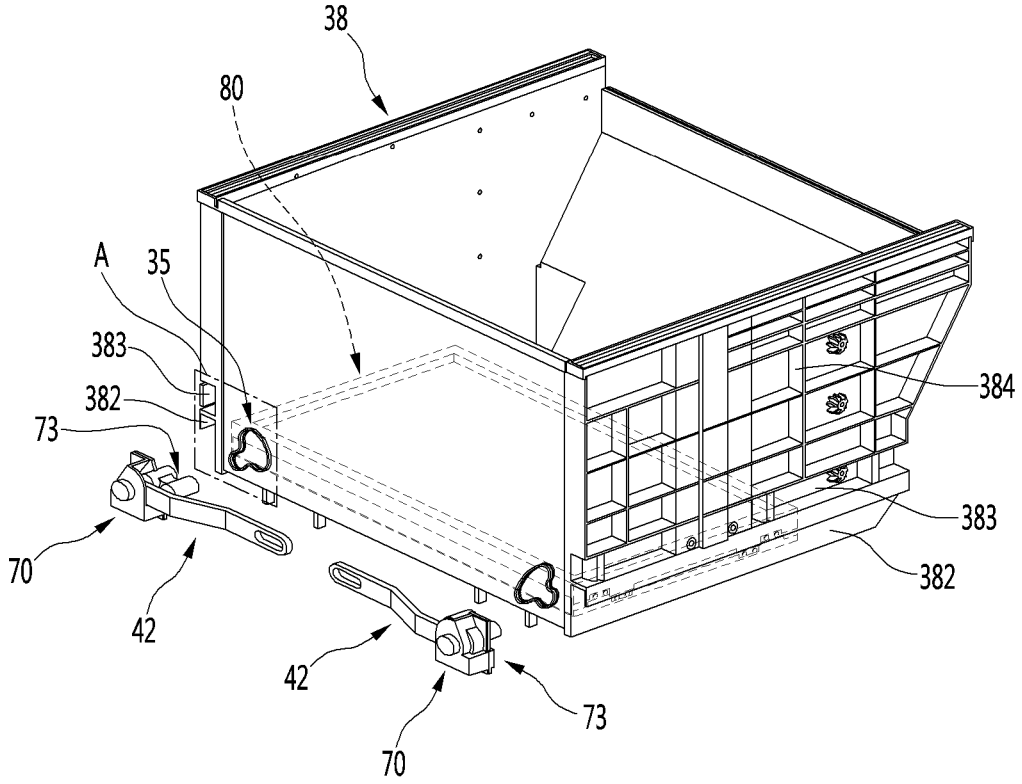
FIG. 15 is an exploded perspective view illustrating a coupling relationship between the drawer part and the connecting assembly.
Figure 26:
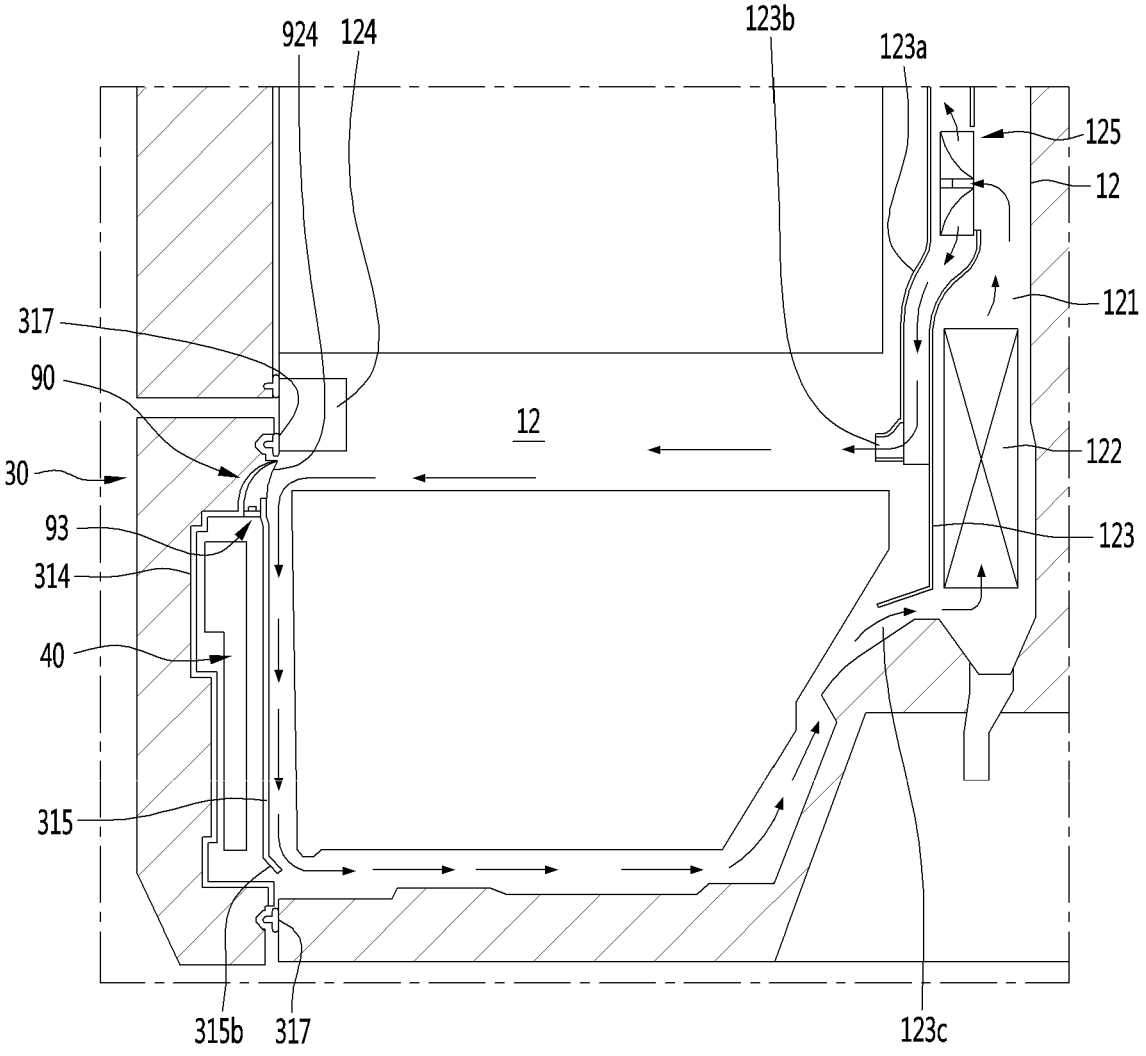
FIG. 26 is a view illustrating a state in which cool air flows within the refrigerator when the drawer door is closed.

FIG. 15 is an exploded perspective view illustrating a coupling relationship between the drawer part and the connecting assembly. Also, FIG. 26 is an enlarged view illustrating portion A of FIG. 15.

As illustrated in the drawings, the drawer opening 35 may be defined in the right and left sides of the lower front of the drawer part 32. The shape of the drawer opening 35 on each of both sides of the right and left sides may be symmetrical to each other, and the rotation shaft 841*a* of the elevation device 80 and the scissors protrusion 841*b* may be exposed through the drawer opening 35. That is, the drawer opening 35 may be opened at a position corresponding to the rotation shaft 841*a* of the elevation device 80 and the scissors protrusion 841*b*.

The drawer opening 35 may include a central portion 351 and a trajectory portion 352. The center portion 351 may be disposed at a position corresponding to the rotation shaft 841*a* of the elevation device 80 and may have a size such that the first connection part 731 of the connection member 73 is inserted. Also, the trajectory portion 352 may be connected to the center portion 351 and may be opened in a shape corresponding to the trajectory in which the second connection part 732 of the connection member 73 move to rotate. Thus, the rotation shaft 841*a* of the elevation device 80 may rotate on the central portion 351 while the scissors protrusion 841*b* of the elevation device 80 rotates along the trajectory portion 352. That is, the scissors protrusion 841*b* and the second connection part 732 may be disposed inside the center portion 351 and the trajectory portion 352 when the elevation device 80 moves vertically.

The height of the drawer opening 35 may be lower than the upper end of the elevation device 80, i.e., the upper surface of the support plate 81. Thus, the drawer opening 35 may be prevented from being seen from the inside of the drawer part 32 in any state in the state in which the elevation device 80 is mounted.

The rotation shaft 841*a* and the scissors protrusion 841*b* of the elevation device 80 may be exposed through the drawer opening 35 while the elevation device 80 is mounted inside the drawer part 32. Also, in the state in which the sub door 30 is coupled, the connection member 73 of the connecting assembly 70 may be inserted through the inside of the drawer opening 35 so as to be coupled to the rotation shaft 841*a* of the elevation device 80 and the scissors protrusion 841*b*.

The connecting assembly 70 may be provided on each of both right and left sides of the drawer part 32 and may have a shape symmetrical to each other. The selective separation of the elevation device 80 and the connecting assembly 70 may be enabled through the manipulation of the push member 74.

The circumference of the support plate 81 may protrude upward so that the container 36 or food can be stably mounted. Also, the circumference of the support plate 81 may extend downward. Thus, the remaining elements of the elevation device may be accommodated below the support plate 81, and the covered and clean outer appearance may be realized by the circumference of the support plate 81.

In addition, the support plate 81 may have a size and a shape corresponding to the front space to prevent foreign matters from being introduced into the elevation device 80 provided below the front space S1, and also, to fundamentally prevent safety accidents from occurring by blocking the access to the elevation device 80.

Hereinafter, elements of the elevation device 80 will be described in more detail.

Figure 16:
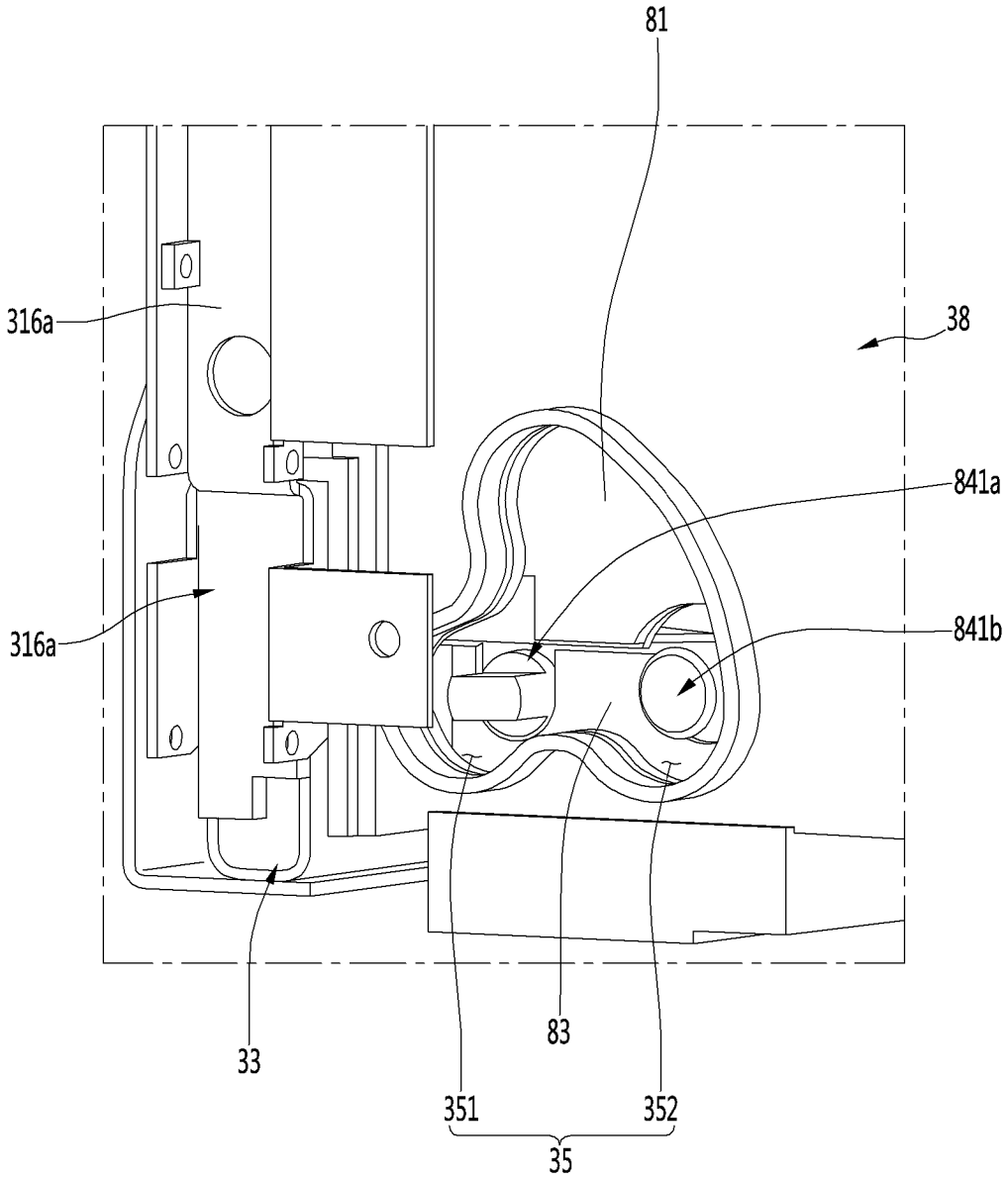
FIG. 16 is an enlarged view illustrating a portion A of FIG. 15.
Figure 17:
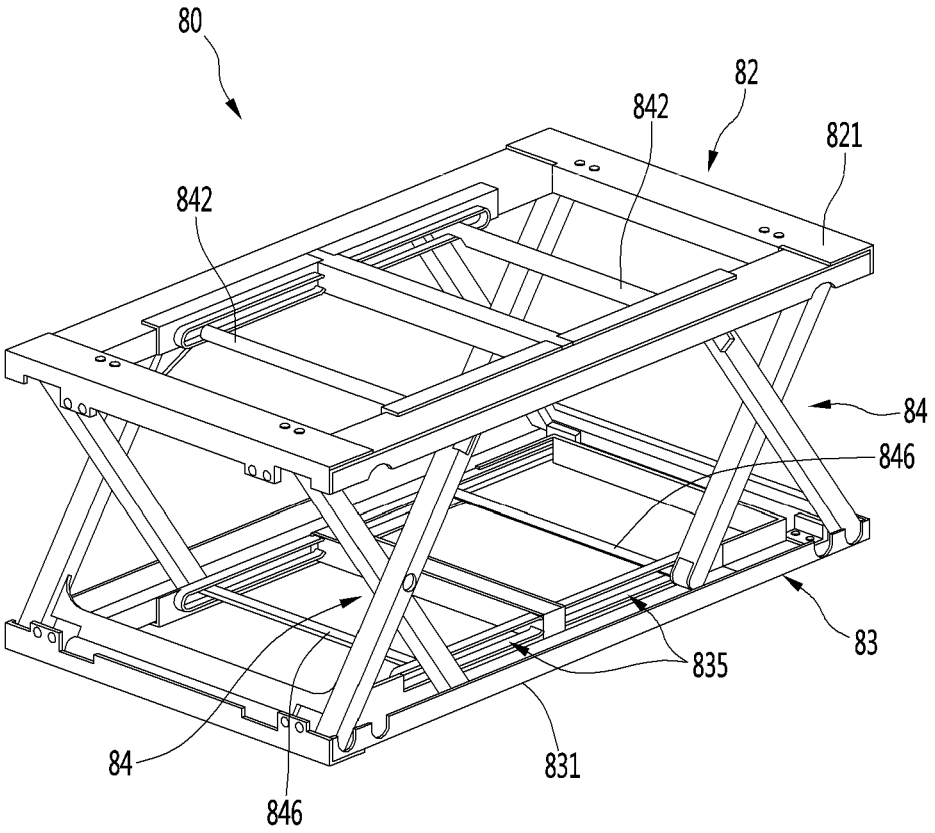
FIG. 17 is a perspective view of an elevation device according to an implementation.
Figure 18:
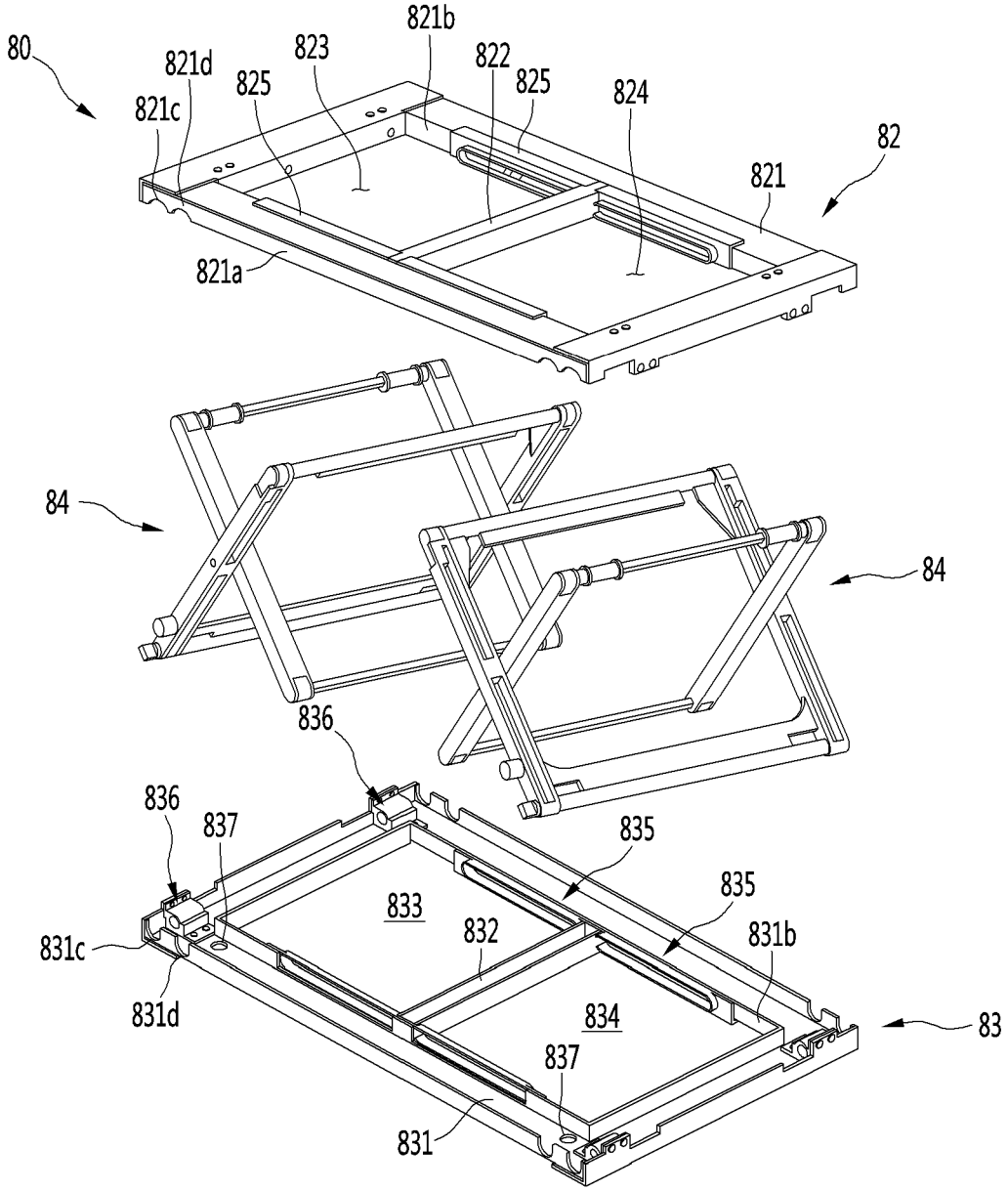
FIG. 18 is an exploded perspective view of the elevation device.
Figure 19:
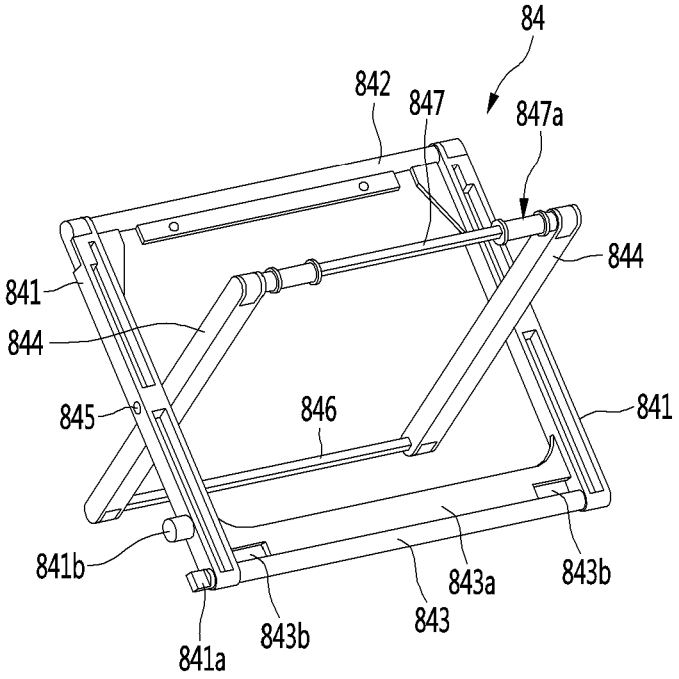
FIG. 19 is an perspective view of a scissors assembly that is one component of the elevation device.

FIG. 16 is an enlarged view illustrating a portion A of FIG. 15. Also, FIG. 17 is a perspective view of the elevation device according to an implementation. Also, FIG. 18 is an exploded perspective view of the elevation device. Also, FIG. 19 is an perspective view of the scissors assembly that is one component of the elevation device.

As illustrated in the drawings, the elevation device 80 may be provided on the bottom surface of the inner side of the drawer part 32 and may be detachably installed on the inside of the drawer part 32. Also, the elevation device 80 may include an upper frame 82 and a lower frame 83 as a whole and a scissors assembly 84 disposed between the upper frame 82 and the lower frame 83.

In detail, the upper frame 82 may have a square frame shape corresponding to the size of the inner front space S1 of the drawer part 32 and may be configured to mount the support plate 81 on the top surface thereof.

The upper frame 82 of the elevating device 80 may move upward and downward and substantially supports the food or the container 36 together with the support plate 81. Also, the upper frame 82 may generally defines a frame part 821 which defines a circumferential shape of the upper frame 82 and a partition part 822 for partitioning the space inside the frame portion 821 into left and right sides.

Since the frame part 821 and the partition part 822 define an outer frame and support the support plate 81, high strength may be required, and thus, the frame part 821 and the partition part 822 may be made of a metal and may have shape in which both ends are bent to increase strength and prevent deformation.

Also, a slide guide 825 may be disposed on each of both sides of the inner side of the frame part 821 to accommodate the end of the scissors assembly 84 and guide the movement of the scissors assembly 84. The slide guides 825 may be disposed on both sides of the partition part 822. Also, the scissors assemblies 84 may be disposed in the spaces 823 and 824 on both sides partitioned by the partition part 822, respectively.

The slide guide 825 may be separately molded by using a plastic material having excellent abrasion resistance and lubrication performance and mounted on the upper frame 82. Also, a long hole 825*a* through which the sliding shaft 842 of the scissors assembly passes may be defined in the slide guide 825, and the sliding shaft 842 may move along the slide guide 825. Also, a sliding surface 825*b* having a predetermined width may be further disposed along the circumference of the lone hole 825*a*, and the sliding shaft 842 may be supported by the sliding surface 825*b* so that the scissors assembly 84 is more smoothly folded or unfolded.

The frame part 821 may include vertically curved edges 821*a* and 821*b* along the circumference thereof. The edges 821*a* and 821*b* may be disposed on the inner side and the outer side of the frame part 821, respectively. Also, the slide guide 825 may be disposed on the edge 821*b* inside the frame part 821. Also, edge grooves 821*c* and 821*d* may be defined in the outer edge 821*a* of the frame part 821.

The edge grooves 821*c* and 821*d* may be defined in the edge 821*a* by the grooves into which the rotation shaft 841*a* of the elevation device 80 and the scissors protrusion 841*b* are accommodated while the elevation device 80 completely descends and may include a first edge groove 821*c* and a second edge groove 821*d* corresponding to the rotation shaft 841*a* and the scissors protrusion 841*b* at the end of the first edge groove 841*a*. When the upper frame 82 completely descends to contact the lower frame 83, the upper frame 82 may contact the edge grooves 821*c* and 821*d* defined in the lower frame 83 to provide a complete hole shape so that the rotation shaft 841*a* and the scissors protrusion 841*b* pass therethrough.

The edge grooves 821*c* and 821*d* may be defined in a number corresponding to the rotation shaft 841*a* when the scissors protrusion 841*b* is not provided but only the rotation shaft 841*a* is provided. The edge grooves 821*c* and 821*d* and the rotation shaft 841*a* and the scissors protrusion 841*b* may be disposed adjacent to the left and right ends of the elevation device 80 and may be exposed through the drawer opening 35.

The frame part 821 may define a space of which a bottom surface is opened by the edges 821*a* and 821*b* on both sides. Also, scissors fixing members may be provided at both ends of the inner space of the frame part 821. The scissors fixing member may fix the rotation shaft 847 of the scissors assembly 84, and a pair of scissors fixing members 826 may be provided at both ends. The scissors fixing member may also be made of an engineering plastic material having abrasion resistance due to continuous friction with the rotating shaft 847. Also, the scissors fixing member may have a through-hole through which the rotation shaft 847 passes.

A plurality of scissors fixing members 826 may be provided on both ends of the frame part 821 to fix both ends of the rotation shaft 847. The scissors fixing member 826 may stably fix the rotation shaft 847 to allow the scissors assembly 84 to be smoothly folded and unfolded.

The lower frame 83 may have the same structure as that of the upper frame 85 but only in the direction. The lower frame 83 may include a frame part 831 and a partition part 832 to define spaces 833 and 834 in which the scissors assemblies 84 are respectively installed.

Also, the slide guide 825 may be provided on the inner frame 821*b* of the frame part 821, and the first frame groove 831*c* and the second frame groove 831*d* may be defined in the outer frame 821*a*. Also, the scissors fixing member 826 may be provided in the inner space of the frame portion 821.

The outer frame 821*a* of the upper frame 82 and the outer frame 821*a* of the lower frame 83 may contact each other when the upper frame 82 completely move downward. Thus, the frame part 821 of the upper frame 82 and the frame part 821 of the lower frame 83 may contact each other to define a closed space therein, and the scissors assembly 84 may be accommodated in the closed space in the completely folded state. That is, the elements of the scissors assembly 84 may be disposed inside the frame part 821 of the lower frame 82 and the upper frame 82 in the state in which the elevation device 80 descends to the lowest state.

Thus, the additional space for accommodating the scissors assembly 84 in addition to the upper frame 82 and the lower frame 83 may not be required so that the loss of storage chamber inside the drawer unit 32 is minimized.

Furthermore, since the support plate 81 also has a structure capable of accommodating the upper frame 82 and/or the lower frame 83, a space for arranging the upper frame 82 and the lower frame 83 may not be additionally required to minimize the space loss.

That is, even if the elevation device 80 having the complicated scissors type is disposed, a space loss equivalent to the thickness of the support plate 81 may be generated to very effectively utilize the interior of the drawer unit 32.

An elevation device fixing part 837 may be disposed on the bottom surface of the frame part 821 of the lower frame 83. The elevation device fixing part 837 may have an opened hole shape and have a protruding shape protruding from the bottom surface of the drawer part 32 when the elevation device 80 is mounted inside the drawer part 32 and may be combined in shape with an elevation device coupling part. That is, the elevation device 80 may be fixed to match the inside of the drawer part 32 by a simple operation that is seated inside the drawer part 32 and be maintained in the stable state even though the elevation device 80 operates. Also, the elevation device 80 may be easily lifted and separated from the drawer part 32 without any additional tool even if the elevation device 80 is not disposed in the drawer part 32.

The scissors assemblies 84 may be provided on both left and right sides of the scissors assembly 84. The scissors assemblies 84 may be connected to the connecting assembly 70 and may be independently driven by the power transmitted through the shaft 41 and the lever 42 to lift the upper frame 82. Here, the scissors assemblies 84 on both sides may not cause any misalignment or deviation in one of the driving motors 64 and the structure of the driving device 40 including the shaft 41 and the screw assembly 50 so as to provide a structure capable of being elevated by the same height.

Thus, the scissors assembly 84 may be effectively elevated by the pair of the scissors assemblies 84 which independently apply the forces to both sides even when the heavy load is supported by the scissors assembly 84. Here, the upper frame 82, i.e., the support plate 81 may be elevated in a horizontal state through the scissor assembly 84.

The scissors assembly 84 may include a pair of first rods 841 arranged in parallel to each other, a first sliding shaft 842 connecting both ends of the first rod 841, and a first rotation shaft 847.

Each of the first rod 841, the first sliding shaft 842, and the first rotation shaft 847 may have a width that is enough to be accommodated inside the frame part 821. Also, the first rod 841 may be disposed at a position corresponding to the region of the frame part 821, and the first rotation shaft 847 may also be disposed at an region corresponding to the frame part 821.

Also, the rotation shaft 841*a* and the scissors protrusion 841*b* may be disposed on one end of the first rod 841. Here, the rotation shaft 841*a* may be disposed on the same extension line as the first rotation shaft 847, and the first rotation shaft 847 may rotate when the rotation shaft 841*a* rotates.

The first rotation shaft 843 may further include a rotation enhancing part 843*a*. The rotation enhancing part 843*a* may be configured to connect a portion of the first rod 841 to the entire first rotation shaft 847. Thus, when the first rod 841 rotates, the first rotation shaft 847 may rotate together and also be enhanced to withstand the generated moment.

Also, a mounting hole 342*b* may be defined in each of both ends of the rotation enhancing part 843*a*, and the scissors fixing member 826 may be mounted to pass through the mounting hole 842*b*. Thus, the first rotation shaft 847 may be rotatably mounted on the scissors fixing member 826 of the lower frame 83.

Also, the first sliding shaft 842 may connect the other end of the first rod 841 and may be disposed to pass through the slide guide 825. Thus, the first sliding shaft 842 may move along the slide guide 825 of the upper frame 82 when the first rod 841 rotates.

Also, a pair of second rods 844 may be provided to cross the first rod 841. The first rod 841 and the second rod 844 may be connected to each other by the scissors shaft 845 so that the first rod 841 and the second rod 844 rotate in the state of crossing each other. A second sliding shaft 842 and a second rotating shaft 847 connecting both ends of the second rod 844 may be further provided.

The second rod 844, the second sliding shaft 842, and the second rotation shaft 847 may also have shapes and arrangements that are enough to be accommodated in the frame part 821. In this state, both the second rotation shafts 847 connecting the upper ends of the second rods 844 may be provided.

The second rotation shaft 847 may be rotatably mounted on the scissors fixing member 826 of the upper frame 82. Here, the second rotation shaft 847 passing through the scissors fixing member 826 may further include a rotation bush 847*a*. The rotation bush 847*a* may contact the inner surface of the scissors fixing member 826 and may be made of a plastic material having excellent lubrication performance and abrasion resistance. Thus, the operation of the scissors assembly 84 may be smoothly performed.

The lower ends of the second rods 844 disposed on both sides may be connected by the second sliding shaft 842. The second sliding shaft 846 may be mounted to pass through the slide guide 835 provided in the lower frame 83 and may move along the slide guide 835 as the elevation device 80 is elevated.

Hereinafter, the selective coupling and power connection of the elevation device 80 and the connecting assembly will be described in more detail with reference to the drawings.

Figure 20:
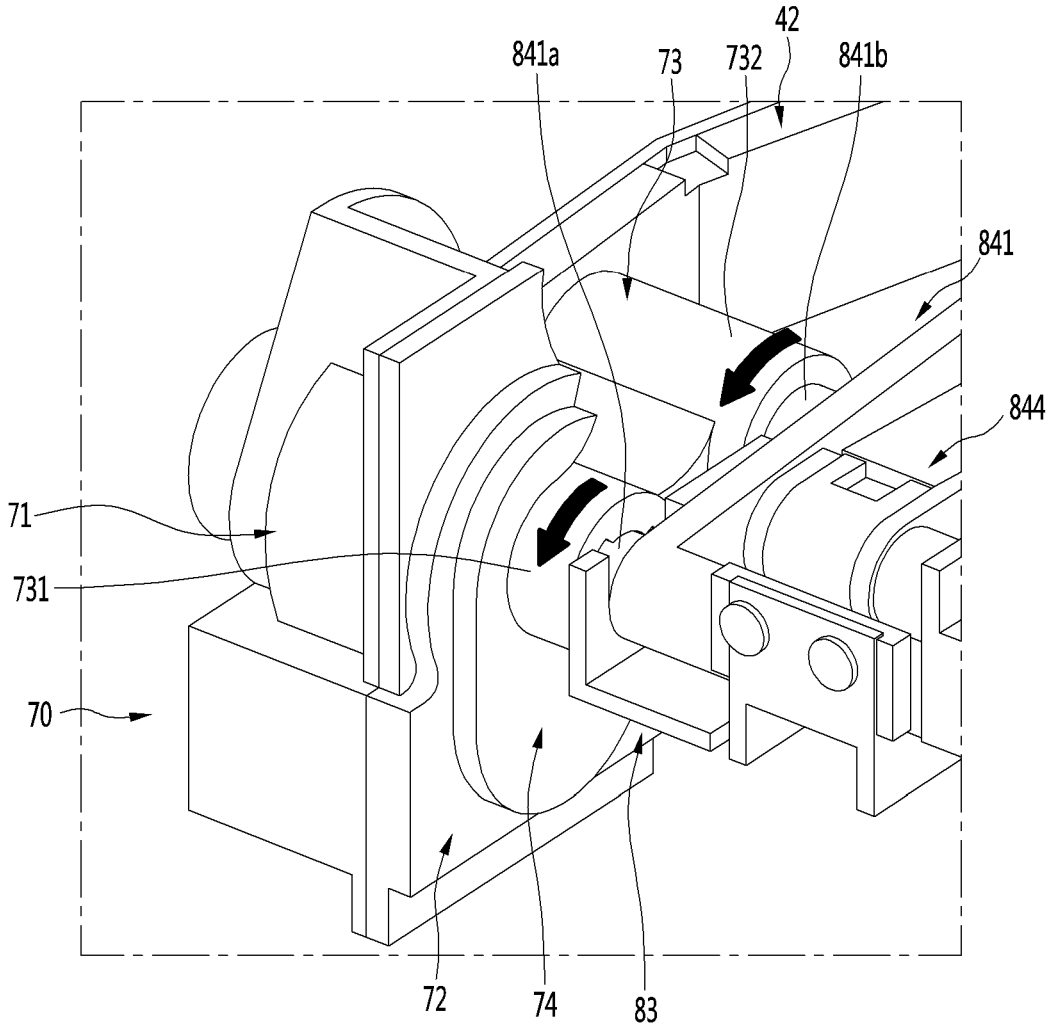
FIG. 20 is a perspective view illustrating a connection state between the connecting assembly and the elevation device.
Figure 21:
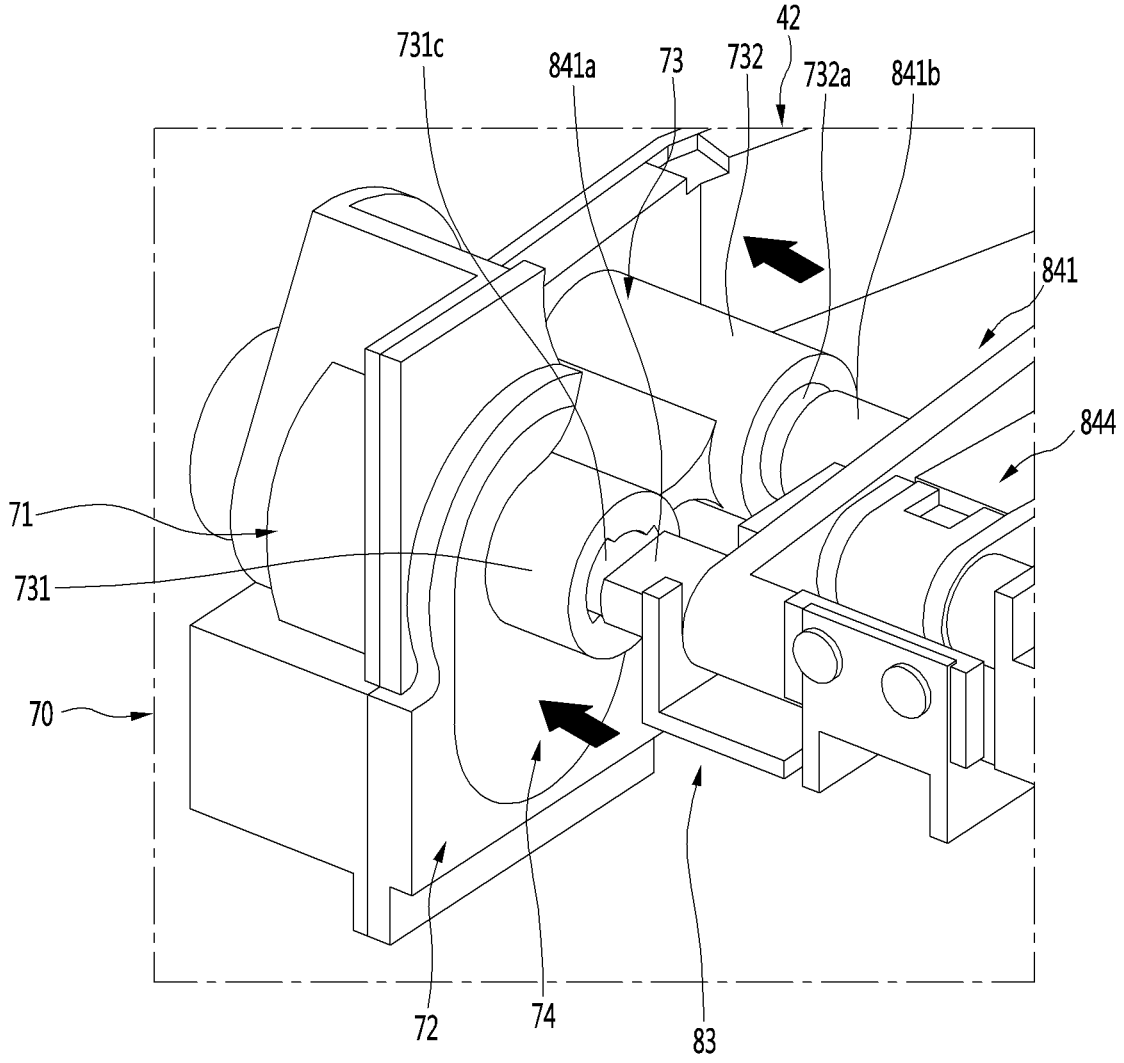
FIG. 21 is a perspective view illustrating a separation state of the connecting assembly and the elevation device.

FIG. 20 is a perspective view illustrating a connection state between the connecting assembly and the elevation device. Also, FIG. 21 is a perspective view illustrating a separation state of the connecting assembly and the elevation device.

As illustrated in the drawings, if the service of the driving device 40 or the elevating device 80 is necessary or if the use of the elevation device 80 is not desired, the driving device 40 and the elevation device 80 may be simply separated from and coupled to each other.

As illustrated in FIG. 20, the door part 31 and the drawer part 32 may be coupled to each other, and power transmission may be possible in the state in which the connecting assembly 70 and the elevation device 80 are connected to each other. Here, the connection member 73 may be connected to the lever 42 and the elevation device 80, and the first connection part 731 may be connected to the fixing shaft 77 and the rotation shaft 841*a* of the elevation device 80. The lever protrusion 425 and the scissors protrusion 841*b* may be inserted into the second connection part 732.

In this state, when the lever 42 rotates by the operation of the driving device 40, the rotation shaft 841*a* of the elevation device 80 may rotate by the first connection part 731, and the scissors assembly 84 of the elevation device 80 may rotate.

Here, since the second connecting part 732 is connected to the scissors protrusion 841*b* of the elevation device 80, greater force may be transmitted to the elevation device 80. In detail, the second connection part 732 may be disposed at a position away from the first connection part 731, and thus when the first connection part 731 rotates around the shaft, a moment similar to a leverage may be applied to the second connection part 732. Thus, a moment greater than the moment generated at the first connection part 731 may be applied together with the second connection part 732, and thus the elevation device 80 may rotate with larger force.

Furthermore, since the pair of scissors assemblies 84 are disposed on both sides of the scissors assembly 84, the power may be transmitted to the scissors assembly 84, thereby effectively elevating the elevation device 80 with less force.

The connection member 73 may have a single shaft structure that connects the lever 42 to the rotation shaft 841*a* of the elevation device 80 when the torque by the driving device is sufficient. The scissors assembly 84 may also be configured so that the connection member 73 is connected to each of both sides of one of the scissors assemblies 84 to elevate the elevation device 80.

The user may push the push member 74 of the connecting assembly 70 to push the connection member 73 as illustrated in FIG. 21 in the state in which the service condition of the driving device or the elevating device 80 of the refrigerator 1 occurs. The coupling between the connection member 73 and the elevation device 80 may be released by allowing the connection member 73 to move forward.

In this state, the door part 31 may be separated from the drawer part 32, and the entire driving part 40 provided in the door part 31 may be completely separated from the drawer part 32 by a single operation.

The driving part 40 may be maintained in the state in which the door part 31 is separated, and the door part 31, which normally operates as necessary, may be replaced to be mounted. Here, the connection member 73 of the door part 31 may be coupled to the rotation shaft 841*a* and the scissors protrusion 841*b* of the lifting device without separate assembly and disassembly.

The door part 31 and the drawer part 32 may be rigidly coupled to each other by the door frame or other structure, and the door part 31 and the drawer part 32 may be additionally separated from or coupled to each other when the door part 31 and the drawer part 32 are separated from or coupled to each other.

Hereinafter, a state in which the door 30 of the refrigerator 1 is inserted and withdrawn and is elevated according to an implementation will be described in more detail with reference to the accompanying drawings.

Figure 22:
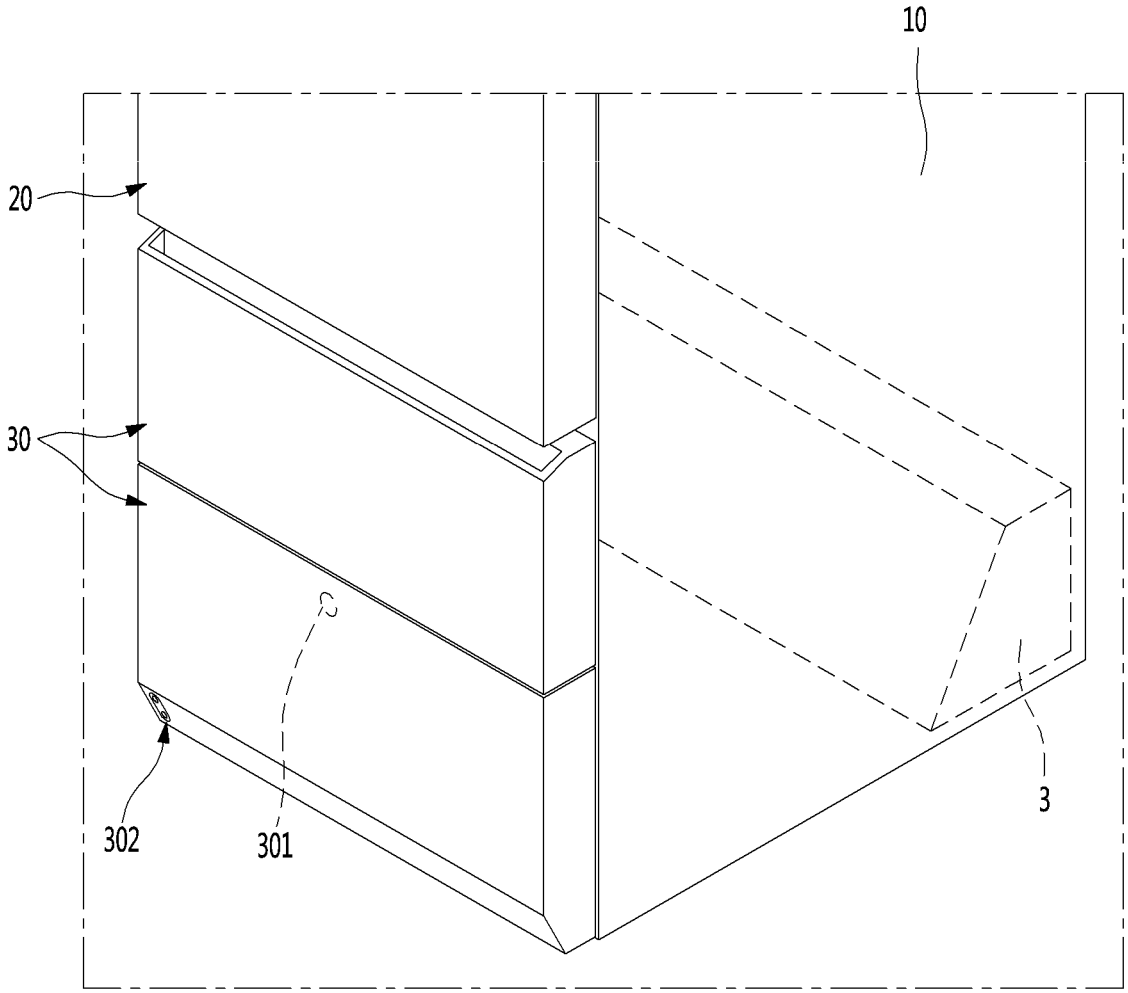
FIG. 22 is a perspective view illustrating a state in which a drawer door is closed.

FIG. 22 is a perspective view illustrating a state in which a drawer door is closed.

As illustrated in the drawing, in the state in which the food is stored, the refrigerator 1 may be maintained in a state in which all of the rotation door 20 and the door 30 are closed. In this state, the user may withdraw the door 30 to accommodate the food.

The door 30 may be provided in plurality in a vertical direction and be withdrawn to be opened by the user's manipulation. Here, the user's manipulation may be performed by touching the manipulation part 301 disposed on the front surface of the rotation door 20 or the door 30. Alternatively, an opening command may be inputted on the manipulation device 302 provided on the lower end of the door 30. Also, the manipulation part 301 and the manipulation device 302 may individually manipulate the insertion and withdrawal of the door 30 and the elevation of the elevation member 80. Alternatively, the user may hold a handle of the door 30 to open the drawer door 30.

Hereinafter, although the lowermost door 30 of the doors 30, which are disposed in the vertical direction, is opened and elevated as an example, all of the upper and lower doors 30 may be inserted and withdrawn and elevated in the same manner.

Figure 23:
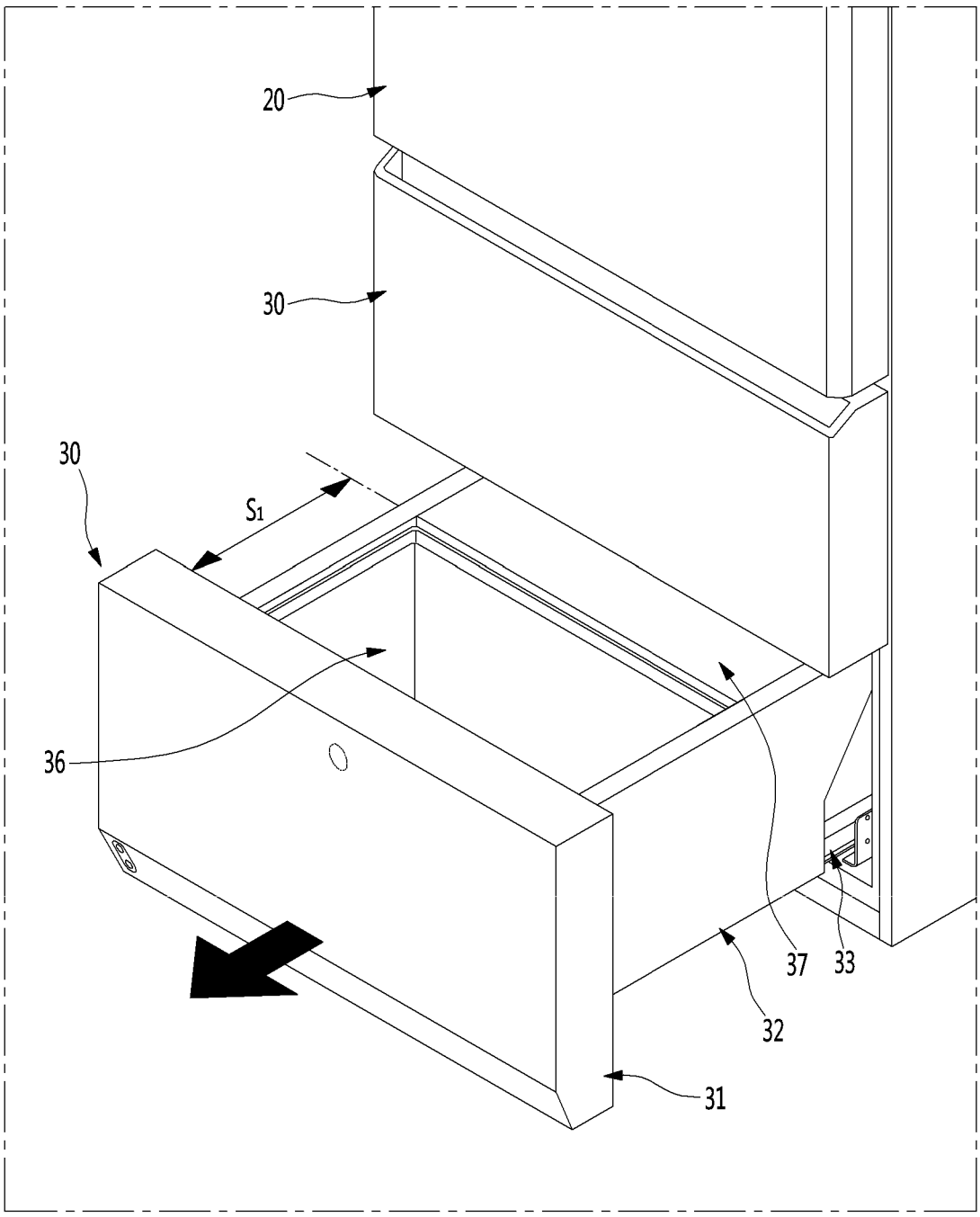
FIG. 23 is a perspective view illustrating a state in which the drawer door is completely opened.
Figure 24:
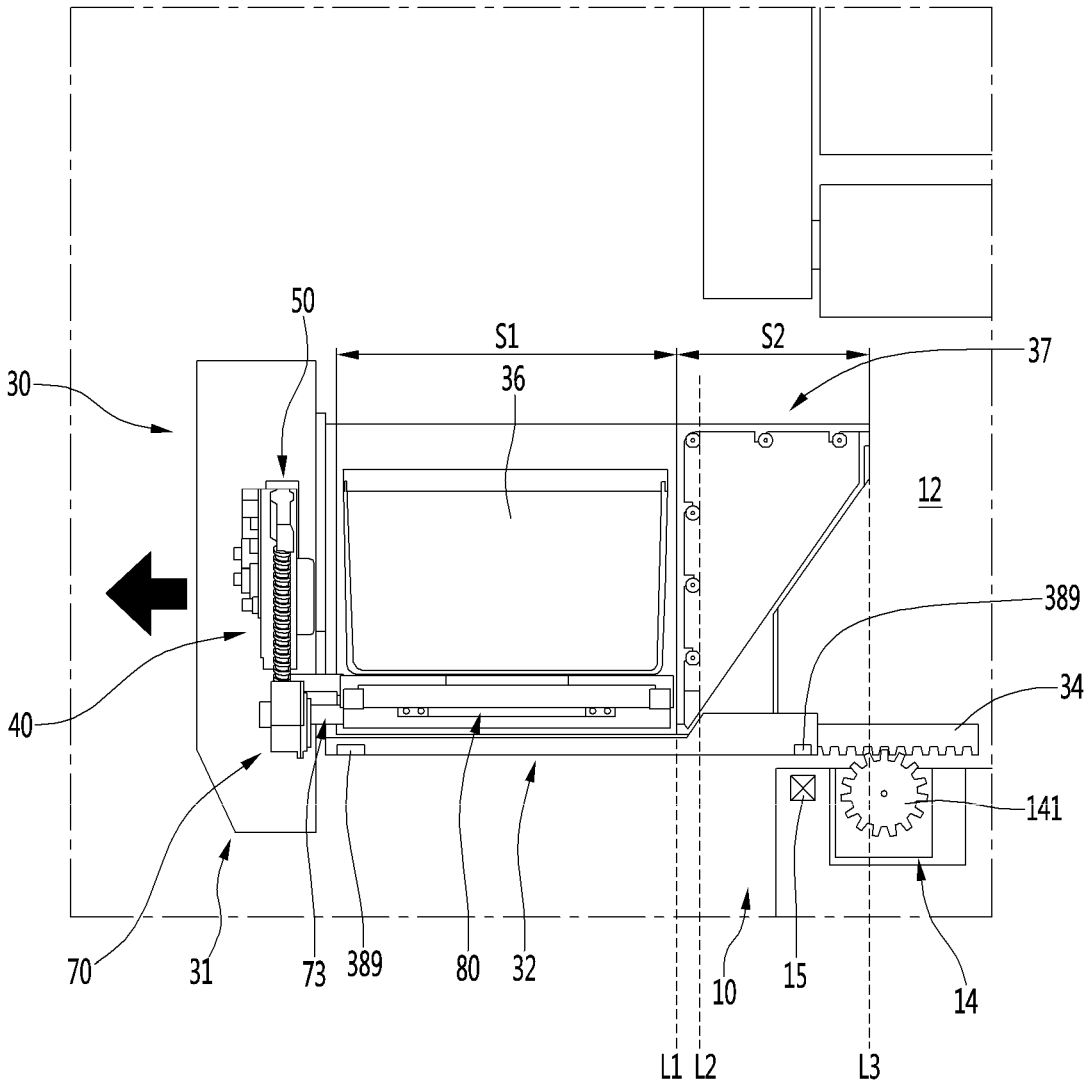
FIG. 24 is a cross-sectional view illustrating a state of the drawer door in a state in which the basket of the drawer door completely descends.

FIG. 23 is a perspective view illustrating a state in which the drawer door is completely opened. Also, FIG. 24 is a cross-sectional view illustrating a state of the drawer door in a state in which the basket of the drawer door completely descends.

As illustrated in the drawings, the user may manipulate the draw-out operation on the door 30 to withdraw the door 30 forward. The door 30 may be withdrawn while the draw-out rail 33 extends.

The door 30 may be configured to be inserted and withdrawn by the driving of the draw-out motor 14, not by a method of directly pulling the door 30 by the user. The draw-out rack 34 provided on the bottom surface of the door 30 may be coupled to the pinion gear 141 rotating when the draw-out motor 14 provided in the cabinet 10 is driven. Thus, the door 30 may be inserted and withdrawn according to the driving of the draw-out motor 14.

The draw-out distance of the door 30 may correspond to a distance at which the front space S1 within the drawer part 32 is completely exposed to the outside. Thus, in this state, when the elevation device 80 is elevated, the container or the food may not interfere with the doors 20 and 30 or the cabinet 10 disposed above it.

Here, a draw-out distance of the door 30 may be determined by a draw-out detection device 15 disposed on the cabinet 10 and/or the door 30. The draw-out detection device 15 may be provided as a detection sensor that detects a magnet 389 to detect a state in which the door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the door 30 is closed and a position of the magnet 389 when the door 30 is completely withdrawn. Thus, the drawn-out state of the door 30 may be determined by the draw-out detection device 15.

Also, in some cases, a switch may be provided at each of positions at which the door 30 is completely inserted and withdrawn detect the drawn-out state of the door 30. In addition, the draw-out state of the door 30 may be detected by counting the rotation number of draw-out motor 14 or measuring a distance between the rear surface of the door part 31 and the front end of the cabinet 10.

In the state in which the door 30 is completely withdrawn, the elevation motor 64 may be driven to elevate the elevation device 80. The elevation device 80 may be driven in an even situation in which the door 30 is sufficiently withdrawn to secure safe elevation of the food or container 36 seated on the elevation device 80.

That is, in the state in which the door 30 is withdrawn to completely expose the front space S1 to the outside, the elevation device 80 may ascend to prevent the container 36 or the stored food seated on the elevation device 80 from interfering with the doors 20 and 30 or the cabinet 10.

Referring to the drawn-out state of the door 30, the front space S1 is to be completely withdrawn to the outside of the lower storage chamber 12 in the state in which the door 30 is withdrawn for the elevation.

Particularly, the rear end L1 of the front space S1 is to be more withdrawn than the front end L2 of the cabinet 10 or the upper door 20. Also, the rear end L1 of the front space S1 is disposed at a further front side than the front end L2 of the cabinet 10 or the door 20 so at to prevent the elevation device 80 from interfering when the elevation device 80 is elevated.

Figure 31:
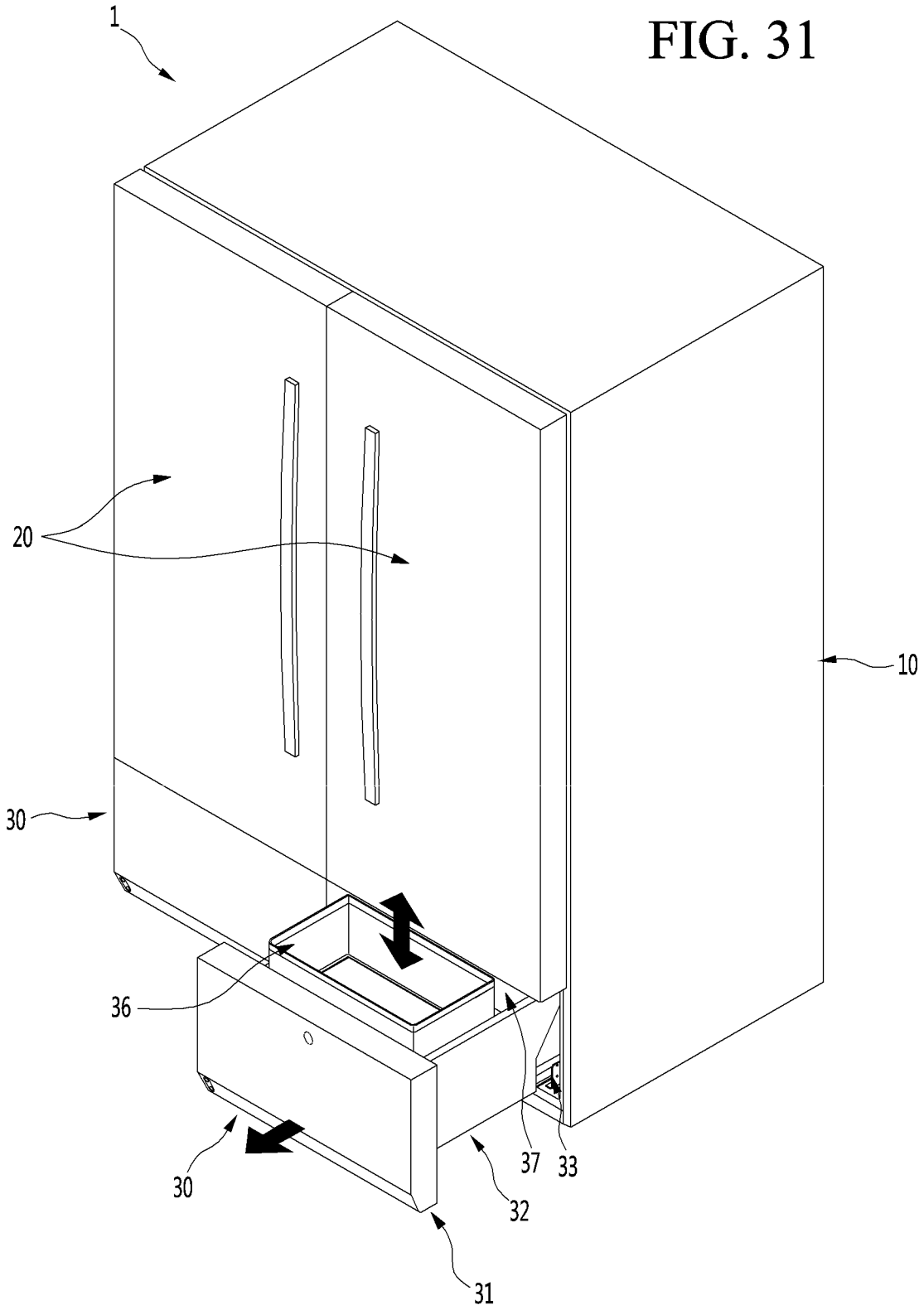
FIG. 31 is a perspective view of a refrigerator according to another implementation.

Also, when the elevating device 80 is completely withdrawn to be driven, the entire drawer part 32 may not be completely withdrawn but withdrawn up to only a position for avoiding interference when the elevating device 80 is elevated as illustrated in FIG. 31. Here, at least a portion of the rear space S2 of the drawer part 32 may be disposed inside the lower storage chamber 12. That is, the rear end L3 of the drawer portion 32 may be disposed at least inside the lower storage chamber 12.

Thus, even when the weight of the stored object is added to the weight of the door 30 itself including the driving device 40 and the elevation device 80, the deflection or damage of the draw-out rail 33 or the door 30 itself may not occur to secure the reliable draw-out operation.

The ascending of the elevation device 80 may start in a state in which the door 30 is completely withdrawn. Also, to secure the user's safety and prevent the food from being damaged, the ascending of the elevation device 80 may start after a set time elapses after the door 30 is completely withdrawn.

After the door 30 is completely withdrawn, the user may manipulate the manipulation part 301 to input the ascending of the elevation device 80. That is, the manipulation part 301 may be manipulated to withdraw the door 30, and the manipulation part 301 may be manipulated again to elevate the elevation device 80.

Also, in the state in which the door 30 is manually inserted and withdrawn, the manipulation part 301 may be manipulated to elevate the elevation device 80.

As illustrated in FIG. 24, the driving device 40 and the elevation device 80 may not operate until the door 30 is completely withdrawn, and the elevation device 80 may be maintained in the lowest state.

Figure 25:
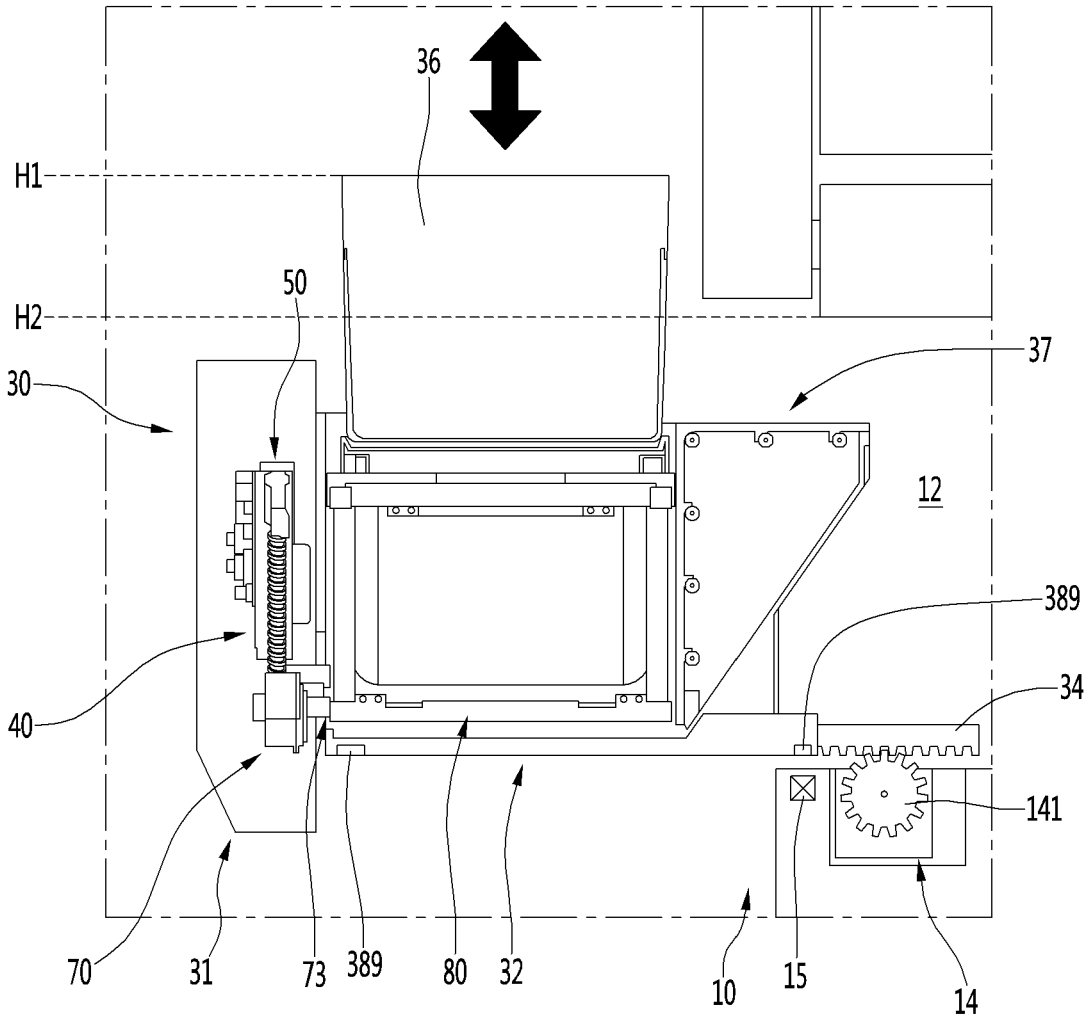
FIG. 25 is a cross-sectional view illustrating a state of the drawer door in a state in which the basket of the drawer door completely ascends.

FIG. 25 is a cross-sectional view illustrating a state of the drawer door in a state in which the basket of the drawer door completely ascends.

As illustrated in FIG. 24, in the state in which the door 30 is withdrawn, when the operation signal of the driving device is inputted, the driving device 40 may operate, and the state as illustrated in FIG. 25 may be obtained by elevating the elevation device 80.

The driving device 40 may be connected to the elevation device 80 by the connecting assembly 70 so that the power is transmitted to the elevation device 80. The power may be transmitted to the elevation device 80 by the connecting assembly 70 together with the operation of the driving device 40, and the elevation device 80 may start to ascend.

The elevation device 80 may continuously ascend and then be stopped when ascend to a sufficient height to facilitate access to the food or container 36 seated on the elevation device 80 as illustrated in FIG. 34. In this state, the user may easily lift the food or container 36 without overtaxing the waist.

When the elevation completion signal of the elevation device 80 is inputted, the driving of the driving motor 64 may be stopped. For this, a height detection device 16 capable of detecting the position of the elevation device 80 may be provided. The height detection device 16 may be provided on the door part 31 and may be disposed at a position corresponding to the maximum height of the elevation device 80 and at a position corresponding to the lowest height of the elevation device 80.

The height detection device 16 may be provided as a detection sensor that detects a magnet 389. The height detection device 16 may detect the magnet 389 disposed on the elevation device 80 to determine whether the ascending of the elevation device 80 is completed. Also, the height detection device 16 may be provided as a switch structure to turn on the switch when the elevation device 80 maximally ascends. Also, the height detection device 16 may be provided on the elevation rail 44 or the screw 52 to detect the maximally ascending position of the elevation member 80. Also, whether the elevation device 80 maximally ascends may be determined according to a variation in load applied to the elevation motor 64.

The driving of the elevation motor 64 is stopped in the state in which the elevation device 80 maximally ascends. In this state, although the elevation device 80 is disposed inside the drawer part 32, the food or container 36 seated on the elevation device 80 may be disposed at a position higher than the opened top surface of the drawer part 32. Thus, the user may easily access the food or container 36. Particularly, it is not necessary to excessively bend at the waist for lifting the container 36, thus resulting in safer and more convenient operation.

In the maximally ascended state of the elevation device 80, the elevation device 80 may be elevated by driving the driving device 40 and be disposed at least at a lower position than the upper end of the drawer part 32.

In the driving device 80, when viewed with respect to the container 36 in the state in which the container 36 is seated, the upper end H1 of the container 36 may ascend to a position higher than the upper end H2 of the lower storage chamber 12. Here, the height of the container 36 may reach a height suitable for the user to reach the container 36 without stretching his/her waist.

That is, the driving device 40 may have a structure in which the container 36 ascends from the inside of the drawer part 32. However, when the container 36 is mounted on the elevation device 80, the container 36 may be disposed at an accessible height.

After the user's food storing operation is completed, the user may allow the elevation device 80 to descend by manipulating the manipulation part 301. The descending of the elevation device 80 may be performed by reverse rotation of the elevation motor 64 and may be gradually performed through the reverse procedure with respect to the above-described procedure.

Also, when the descending of the elevation device 80 is completed, i.e., in the state of FIG. 31, the completion of the descending of the elevation device 80 may be performed by the height detection device 16. The height detection device 16 may be further provided at a position that detects the magnet disposed on the elevation device 80 when the elevation device 80 is disposed at the lowermost descending position. Thus, when the completion of the descending of the elevation device 80 is detected, the driving of the driving motor 40 is stopped.

Also, after the driving of the elevation motor 64 is stopped, the door 30 may be inserted. Here, the door 30 may be closed by the user's manipulation or by the driving of the draw-out motor 14. When the door 30 is completely closed, a state of FIG. 29 may become.

Hereinafter, a cooling structure of the lower storage chamber 12 of the refrigerator 1 will be described.

Figure 27:
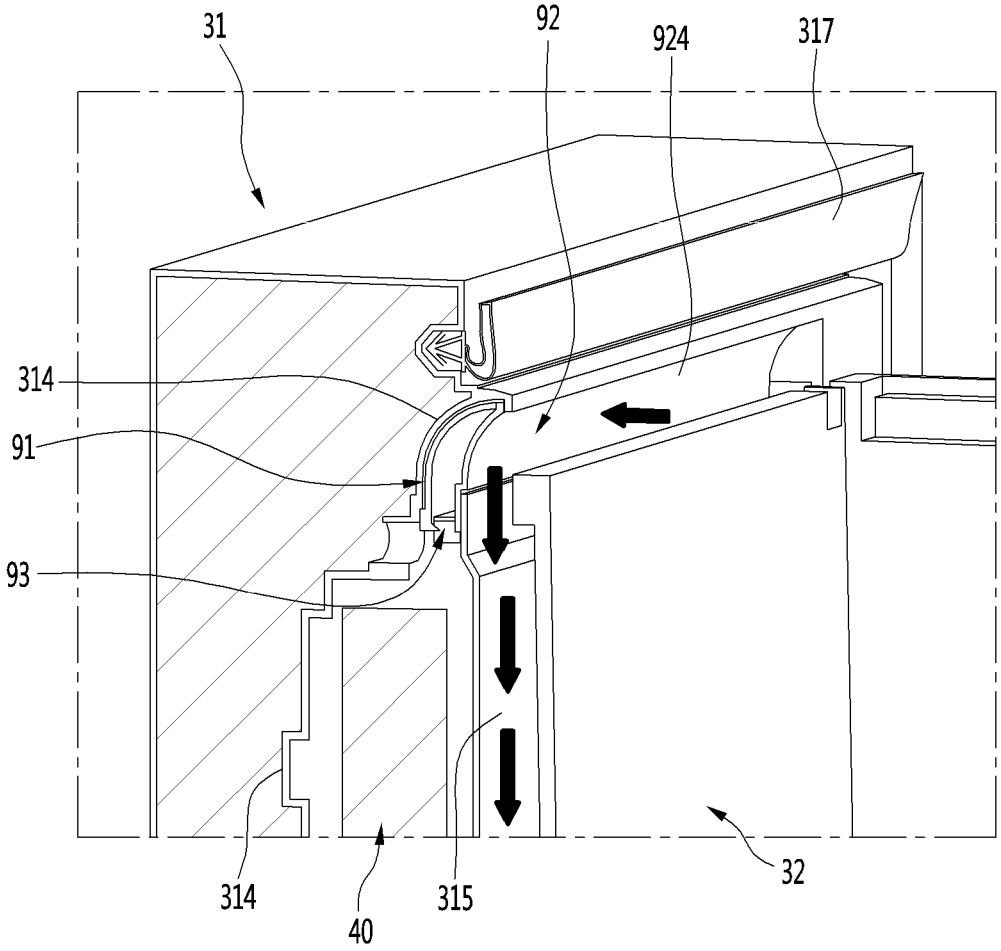
FIG. 27 is a cutaway perspective view illustrating a flow of cool air in an upper portion of a rear surface of the drawer door.
Figure 28:
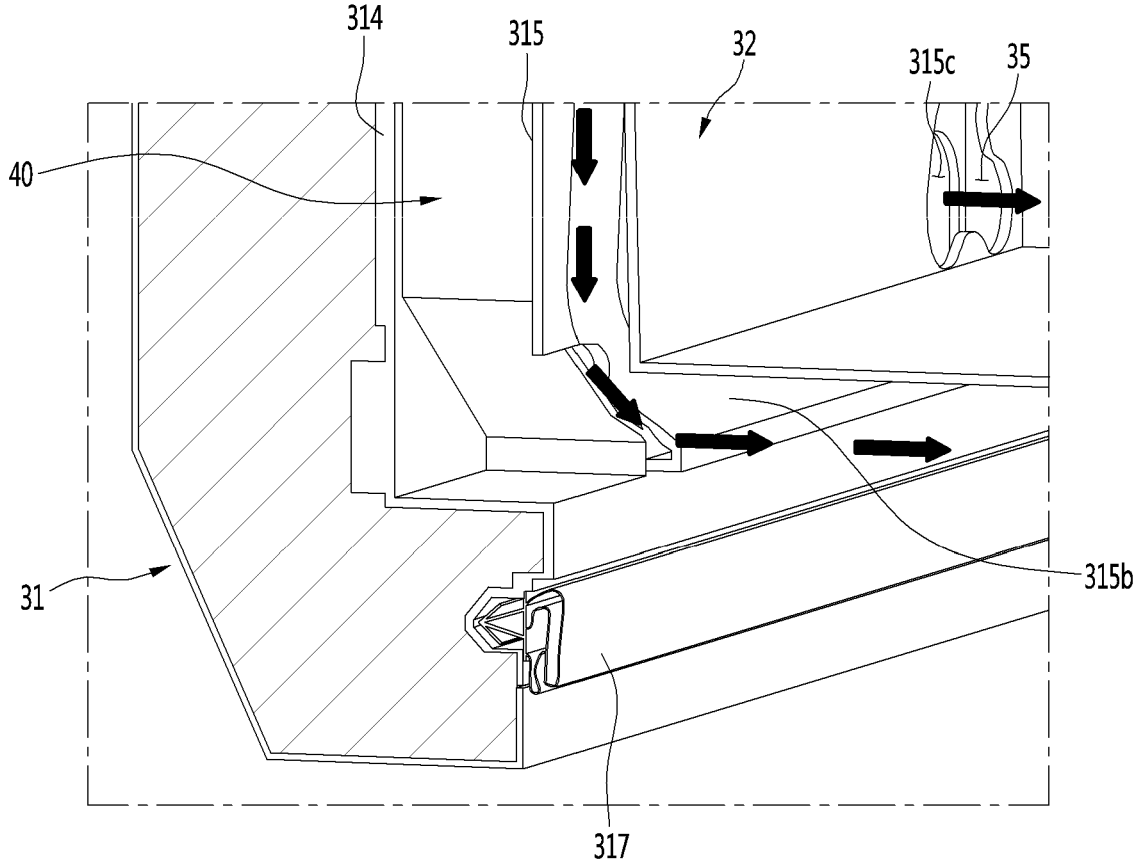
FIG. 28 is a cutaway perspective view illustrating a flow of cool air in a lower portion of a rear surface of the drawer door.

FIG. 26 is a view illustrating a state in which cool air flows within the refrigerator when the drawer door is closed. Also, FIG. 27 is a cutaway perspective view illustrating a flow of cool air in the upper portion of the rear surface of the drawer door. Also, FIG. 28 is a cutaway perspective view illustrating a flow of cool air in the lower portion of the rear surface of the drawer door.

As illustrated in the drawings, in a state in which the drawer door 30 is closed, the inside of the lower storage chamber 12 may be cooled. Here, the lower storage chamber 12 may be vertically divided into two spaces, in which the drawer door 30 is accommodated, by a partition member 124.

The lower storage chamber 12 has a shape defined by an inner case 12. Also, a heat exchange space in which the lower evaporator unit 122 is accommodated may be defined in a rear portion of the lower storage chamber 12. The lower evaporator unit 122 may be covered by the grill fan assembly 123 and be divided into the space in which the drawer part 32 is accommodated and the heat exchange space 121 by the grill fan assembly 123.

Also, a fan 125 may be mounted on the grill fan assembly, The fan 125 may operate to supply and circulate cool air to the lower storage chamber 12. Also, a passage member 123*a* for guiding the supply of the cool air when the fan 125 operates may be provided in the grill fan assembly 123. The air forcibly flowing by the fan 125 may be discharged and suctioned through the passage member 123*a* at a specific position.

An outlet 123*b* and an inlet 123*c* may be provided in the grill fan assembly 123 or the passage member 123*a*. The outlet 123*b* and the inlet 123*c* may be disposed on the rear wall of the lower storage chamber 12. Also, the outlet 123*b* may be disposed higher than the upper end of the drawer part 32 and be disposed to face the lighting unit 90 of the door part 31, i.e., the cover guide part 924.

Thus, the cool air discharged from the outlet 123*b* by the driving of the fan 125 may be discharged forward from the upper side of the drawer part 32. The cool air discharged forward may flow up to the rear surface of the door part 31 without being affected by the drawer part 32.

The cover guide part 924 may be disposed to protrude from the upper end of the front surface of the drawer part 32. Thus, the cool air flowing forward may flow downward by contacting the cover guide part 924.

Here, the rear surface of the door part 31, i.e., the door cover 315 and the front surface of the drawer part 32 may define a space in a state of being spaced apart from each other. Thus, the cool air guided by the cover guide part 924 may flow downward through the space defined between the door cover 315 and the front surface of the drawer part 32.

The cool air flowing downward along the door cover 315 may be guided to the rear side of the drawer by the lower air guide 315*b* disposed on the lower end of the door cover 315. The lower air guide 315*b* may further extend downward from the lower end of the drawer part 32 and also be inclined or rounded in the downwardly extending direction.

Thus, the cool air flowing along the door cover 315 may be guided to the lower side of the drawer part 32 by the lower air guide 315*b* and be guided backward along the lower side of the drawer part 32.

That is, the cool air flowing up to the lower side of the drawer part 32 may be guided by the lower end of the door cover 315 to flow backward through the space between the bottom surface of the drawer part 32 and the bottom surface of the lower storage chamber 12 and then be suctioned through the inlet 123*c* so as to be collected into the evaporator unit 122.

The cool air flowing to the inside of the lower storage chamber 12 may flow forward from the upper side of the rear side of the drawer part 32 via the drawer part 32 to flow to the lower side via the front surface of the drawer part 32 and then be introduced again into the inlet 123*c* via the bottom surface of the drawer part 32 to circulate.

Thus, the entire cool air may flow along the circumference of the drawer part 32. Particularly, the cool air may effectively cool the front surface of the drawer part 32, which is far away from the outlet 123*b* and structurally contacts the door part 31 so that the cool air does not smoothly flow.

Furthermore, a plurality of plates 391, 392, and 395 may be disposed on outer and inner surfaces of the drawer part 32. Thus, the entire drawer part 32 may be uniformly cooled by conduction along the plurality of metal plates 391, 392, and 395.

Particularly, the inside of the drawer part 32 may be uniformly cooled even in a situation in which the cool air flow inside the drawer part 32 is not smooth due to the structure in which the container is accommodated in the drawer part 32.

An opening may be further defined in the lower end of the front surface of the drawer part 32 corresponding to the lower air guide 315*b*. A portion of the cool air flowing between the rear surface of the door part 31 and the front surface of the drawer part 32 may be directly supplied to the inside of the drawer part 32 through the opening. Here, the opening defined in the drawer part 32 may include the drawer opening 35, and also, an addition opening may be defined in the lower end of the front surface of the drawer part 32.

Thus, the cool air may be directly supplied to the lower portion of the inside of the drawer part 32, which is away from the outlet 123*b*, to effectively cool the inside of the drawer part 32.

In addition to the foregoing implementation, various implementations may be exemplified.

Hereinafter, another implementations will be described with reference to the accompanying drawings. In the other implementations of the present disclosure, the same reference numerals are used for the same components as those of the above-described implementations, and a detailed description thereof will be omitted.

Figure 29:
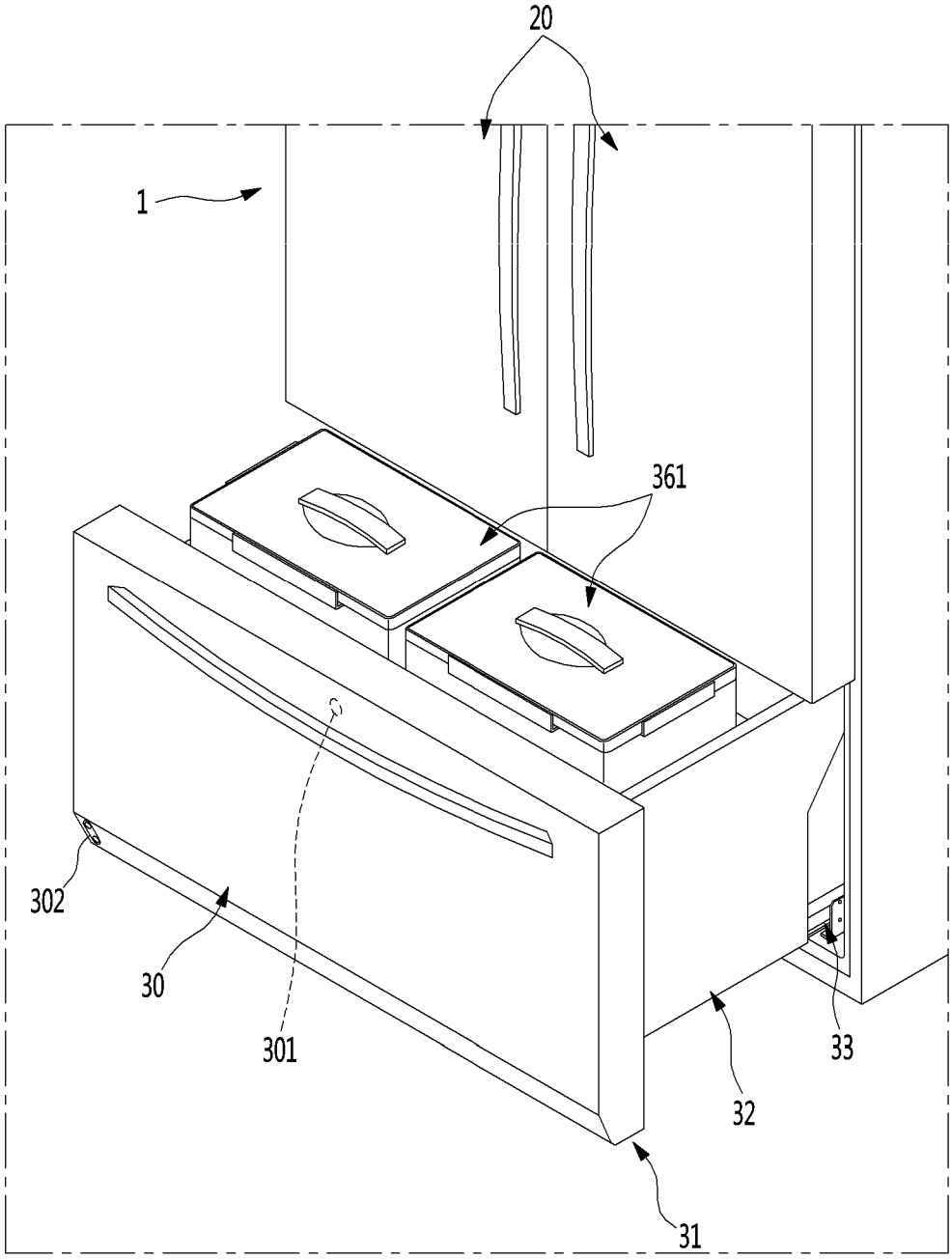
FIG. 29 is a perspective view of a refrigerator according to another implementation.

FIG. 29 is a perspective view of a refrigerator according to another implementation.

As illustrated in the drawing, a refrigerator 1 according to another implementation may include a cabinet 10 having a storage chamber that is vertically partitioned and a door 2 opening and closing the storage chamber.

The door 2 may include a rotation door 20 which is provided in an upper portion of a front surface of the cabinet 10 to open and close an upper storage chamber and a door 30 disposed in a lower portion of the front surface of the cabinet 10 to open and close a lower storage chamber. The door 30 may be inserted and withdrawn forward and backward in the above implementation, and the container and the food inside the drawer part 32 may be vertically elevated by the operation of the driving device 40 and the elevation device 80 inside the door 30.

The elevation device 80 may be provided in the region of the front space of the inside of the drawer part 32. Thus, the elevation device 80 may elevate the food in the region of the front space among the entire region of the drawer part 32.

A manipulation part 301 or a manipulation device 302 may be provided at one side of the door part 31, and the driving part 40 may be installed inside the door part 31. Also, the pulling-out operation of the drawer door 30 and/or the elevation of the elevation device 80 may be carried out by the manipulation of the manipulation part 301 or the manipulation device 302.

The drawer part 32 may be provided with the elevation device 80. The elevation device 80 may be elevated by a connecting assembly that connects the driving device to the elevation device. implementation A plurality of containers 361 may be provided in the elevation device 80. The container 361 may be a sealed container such as a kimchi box, and a plurality of the containers 361 may be seated on the elevation device 80. The container 361 may be elevated together with the elevation device 80 when the elevation device 80 is elevated. Thus, in the state in which the container 361 ascends, at least a portion of the drawer part 32 may protrude, and thus, the user may easily lift the container 361.

The elevation device 80 may interfere with the rotation door 20 in the rotation door 20 is opened even though the drawer door 30 is withdrawn. Thus, the elevation device 80 may ascend in a state in which the rotation door 20 is closed. For this, a door switch for detecting the opening/closing of the rotation door 20 may be further provided.

Also, a lighting unit 90 may be provided in the door part 31. The cover guide part 924 and the lower air guide 315*b* may be provided to allow the cool air to flow between the door part 31 and the drawer part 32. Also, the entire cool air may flow along the circumference of the drawer part 32. An outer appearance of the drawer part 32 may be defined by a plurality of plates 391, 392, and 395 so that the entire drawer part 32 is uniformly cooled.

Figure 30:
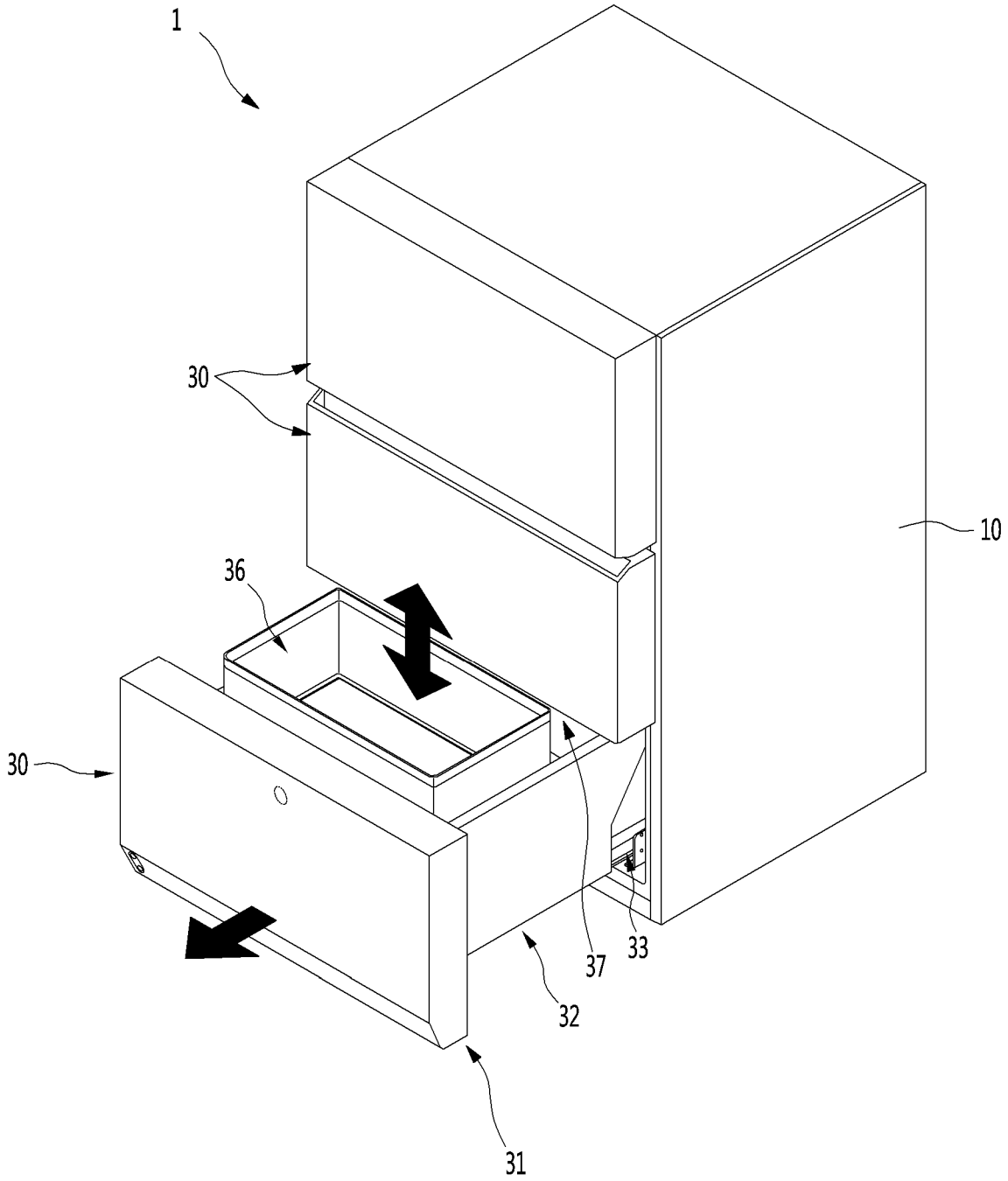
FIG. 30 is a perspective view of a refrigerator according to another implementation.

FIG. 30 is a perspective view of a refrigerator according to another implementation.

As illustrated in the drawings, a refrigerator 1 according to another implementation includes a cabinet 10 defining a storage chamber therein and a door 2 opening and closing an opened front surface of the cabinet 10, which define an outer appearance of the refrigerator 1.

The door 2 may include a drawer door 30 that defines an entire outer appearance of the refrigerator 1 in a state in which the door 2 is closed and is withdrawn forward and backward. A plurality of the drawer doors 30 may be continuously arranged in the vertical direction. Also, the drawer doors 30 may be independently withdrawn by the user's manipulation. The drawer door 30 may be provided with the driving device 40 and the elevation device 80.

The driving part 40 may be installed in the door part 31, and the elevation part 80 may be provided inside the drawer part 32. Also, the driving device 40 and the elevation device 80 may be connected to each other by the connecting assembly 70 when the door part 31 and the drawer part 32 are coupled to each other. Also, the elevation device 80 may be disposed in the front space S1 of the total storage chamber of the drawer part 32.

The insertion and withdrawal of the drawer door 30 and the elevation of the elevation device 80 may be individually performed. After the drawer door 30 is withdrawn, the elevation device 80 may ascend. Then, after the elevation device 80 descends, the insertion of the drawer door 30 may be continuously performed.

Also, when the plurality of drawer doors 30 are vertically arranged, the elevation device 80 inside the drawer door 30, which is relatively downwardly disposed, may be prevented from ascending in a state where the drawer door 30 is relatively drawn upward. Thus, the drawer door 30 may be prevented from interfering with the drawer door 30 in which the food and container are withdrawn upward.

Also, although the elevation device 80 ascends in the state in which the drawer door 30 that is disposed at the uppermost side is withdrawn in FIG. 38, all of the drawer doors disposed at the upper side may also be elevated by the elevation device 80 that is provided inside.

If a height of each of the drawer doors 30 disposed at the upper side is sufficiently high, only the drawer door 30 disposed at the lowermost position or the elevation device 35 of the of drawer doors 30 disposed relatively downward may be elevated.

Also, a lighting unit 90 may be provided in the door part 31. The cover guide part 924 and the lower air guide 315*b* may be provided to allow the cool air to flow between the door part 31 and the drawer part 32. Also, the entire cool air may flow along the circumference of the drawer part 32. An outer appearance of the drawer part 32 may be defined by a plurality of plates 391, 392, and 395 so that the entire drawer part 32 is uniformly cooled.

FIG. 31 is a perspective view of a refrigerator according to another implementation.

As illustrated in the drawings, a refrigerator 1 according to another implementation includes a cabinet 10 defining a storage chamber therein and a door 2 opening and closing an opened front surface of the cabinet 10, which define an outer appearance of the refrigerator 1.

The inside of the cabinet 10 may be divided into an upper space and a lower space. If necessary, the upper and lower storage chambers may be divided again into left and right spaces.

The door 2 may include a rotation door 20 which is provided in an upper portion of the cabinet 10 to open and close the upper storage chamber and a drawer door 2 disposed in a lower portion of the cabinet 10 to open and close the lower storage chamber.

Also, the lower space of the cabinet may be divided into left and right spaces. The drawer door 30 may be provided in a pair so that the pair of drawer doors 30 respectively open and close the lower spaces. A pair of the drawer doors 30 may be arranged on both sides of the right and left sides of the drawer door 30. The drawer door 30 may include the driving device 40 and an elevation device 80.

The driving part 40 may be installed in the door part 31, and the elevation part 80 may be provided inside the drawer part 32. Also, the driving device 40 and the elevation device 80 may be connected to each other by the connecting assembly 70 when the door part 31 and the drawer part 32 are coupled to each other. Also, the elevation device 80 may be disposed in the front space S1 of the total storage chamber of the drawer part 32.

The drawer door 30 may have the same structure as the drawer door according to the foregoing implementation. Thus, the drawer door 30 may be inserted and withdrawn by user's manipulation. In the drawer door 30 is withdrawn, the elevation device 80 may ascend so that a user more easily accesses a food or container within the drawer door 30.

Also, a lighting unit 90 may be provided in the door part 31. The cover guide part 924 and the lower air guide 315*b* may be provided to allow the cool air to flow between the door part 31 and the drawer part 32. Also, the entire cool air may flow along the circumference of the drawer part 32. An outer appearance of the drawer part 32 may be defined by a plurality of plates 391, 392, and 395 so that the entire drawer part 32 is uniformly cooled.

The following effects may be expected in the refrigerator according to the proposed implementations of the present disclosure.

The refrigerator according to the implementation, the portion of the storage chamber within the drawer door may be elevated in the state in which the drawer door is withdrawn. Thus, when the food is accommodated in the drawer door disposed at the lower side, the user may not excessively turn its back to improve the convenience in use.

Particularly, in order to lift heavy food items or the container containing such items, the user has to lift the food or container with a lot of power. However, the elevation within the drawer door may ascend up to a convenient position by driving the driving device to prevent the user from being injured and significantly improve the convenience in use.

Also, the driving device that includes the electric devices for providing the power may be provided inside the door part, and the elevation device for the elevation may be provided inside the drawer part so that the driving device and the elevation device are not exposed to the outside to improve the outer appearance.

Particularly, the driving device that includes the electric devices may be disposed inside the door part, and it may be possible to prevent the user from accessing the door to prevent the occurrence of the safety accident.

Also, the driving device may be provided in the door to block the noise and reduce noise during the use.

Also, the driving part that occupies a large space may be disposed in the door part to minimize the storage capacity loss of the drawer part. Also, the elevation device or the structure that is compactly folded and accommodated in the descending state may be provided to secure the storage capacity in the refrigerator.

Also, the plate defining the outer appearance may be provided inside and outside the drawer part. Thus, the outer appearance may be more elegant by the plates made of metal or having a metallic texture, and the features within the refrigerator may be covered so as not to be exposed, thereby helping to realize a more clean outer appearance.

In addition, when the inner and outer appearances of the drawer part is formed by the metal plates, the cool air within the refrigerator may be uniformly conducted through the plates to uniformly cool the entire drawer part.

In addition, the cool air supplied forward from the rear wall surface of the storage chamber may flow to the rear surface of the door via the upper side of the drawer part and then flow upward along the rear surface of the door and the front surface of the drawer part by the guide part disposed on the rear surface of the door. In addition, the air guided through the guide part may flow to the lower side of the drawer part via the front surface of the drawer part and then flows again backward to flow along the entire circumference of the drawer part. Therefore, the entire drawer part including the front portion thereof may be effectively cooled to cool the entire drawer part at the uniform temperature. Particularly, when the inner and outer surfaces of the drawer part are provided as the metal plates, the entire drawer part may be more uniformly cooled by the whole flowing of the cool air and the conduction of the plates to maintain the more uniform temperature.

In addition, the guide part may be disposed on the lighting unit for illuminating the drawer part. Thus, the drawer part may be illuminated by using the lighting unit, and the flow of the cool air may be guided to improve the use convenience and the cooling performance at the same time.

Particularly, the lighting unit may be disposed on the rear surface of the door. Here, the lighting unit may be disposed above the upper end of the front surface of the drawer part to effectively illuminate the internal space of the drawer part as well as guide the flow of the cool air. Thus, in the state in which the user withdraws the drawer part, the foods within the drawer part may be more easily identified.

In addition, in the rear surface of the door part, the upper air guide may be disposed on the lighting unit so that the cool air flows from the upper side to the lower side of the front surface of the drawer part, and the lower air guide may be disposed on the lower end of the door cover so that the cool air flows from the lower side the rear side of the front surface of the drawer part. Thus, the cool air on the front surface of the drawer part, on which the flow of the cool air is structurally weak may smoothly flow to improve the cooling performance of the drawer part.

In addition, the cool air moving along the rear surface of the door by the guide part may pass through the driving device disposed on the rear surface of the door to effectively cool the heat generated in the driving device.

Therefore, the temperature of the front portion of the drawer part may be prevented from increasing, and also, the overheating of the driving device may be prevented to secure the uniform cooling of the entire drawer part.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage chamber;

a heat exchange space that is defined by the cabinet and positioned rearward of the storage chamber;

an evaporator unit that is provided at the heat exchange space;

a grill fan assembly that provides a barrier between the heat exchange space and the storage chamber, the grill fan assembly comprising an inlet for receiving air from the storage chamber, an outlet for sending air to the storage chamber, and a fan for circulating air between the storage chamber and the heat exchange space;

a drawer door that is configured to be inserted into and withdrawn out of the storage chamber, the drawer door comprising a drawer part that defines a storage space and a door part that is configured to, based on the drawer door being inserted into and withdrawn out of the storage chamber, open and close the storage chamber, respectively, the storage space having an opening that is upwardly opened and opposite to a bottom of the cabinet;

a draw-out rail provided between an inner surface of the storage chamber and both lateral sides of the drawer door, the draw-out rail being configured to guide a movement of the drawer door into and out of the storage chamber; and a lighting unit provided at a rear surface of the door part and configured to illuminate the drawer part, the lighting unit comprising an upper air guide that extends vertically to a position vertically higher than the opening of the storage space, the upper air guide being configured to guide air coming from the outlet of the grill fan assembly in a downward direction relative to the opening of the storage space.

2. The refrigerator according to claim 1, wherein the lighting unit extends in a horizontal direction along a width of the drawer part and has a width equal to or greater than that of the drawer part.

3. The refrigerator according to claim 1, wherein the upper air guide protrudes increasingly rearward toward an upper side of the door part and has an inclined or rounded shape.

4. The refrigerator according to claim 1, wherein the lighting unit comprises:

a lighting module configured to emit light and including a substrate on which a plurality of light emitting diodes (LEDs) are disposed along a longitudinal direction;

a lighting case on which the lighting module is mounted; and a lighting cover that covers the lighting case, the lighting cover being made from a transparent material and configured to allow at least a portion of light emitted from the lighting module to pass therethrough, wherein the upper air guide is disposed on the lighting cover.

5. The refrigerator according to claim 4, wherein the lighting case defines a module mounting groove into which the substrate of the lighting module is inserted and in which the lighting module is mounted such that the LEDs emit light in an upward direction.

6. The refrigerator according to claim 4, wherein the lighting case includes a reflection part having a rounded or inclined shape and configured to reflect light emitted from the lighting module at a lower side of the lighting unit toward the drawer part.

7. The refrigerator according to claim 4, wherein the upper air guide is spaced apart from a front surface of the drawer part to thereby guide cold air to flow along a rear surface of the door part and the front surface of the drawer part.

8. The refrigerator according to claim 4, wherein the outlet and the upper air guide are disposed vertically higher than an upper end of the drawer part.

9. The refrigerator according to claim 4, wherein the drawer part includes an elevation device configured to support and vertically elevate food items, and wherein the door part includes a driving device that is configured to transmit a driving force to the elevation device to thereby vertically elevate the food items.

10. The refrigerator according to claim 9, wherein the door part comprises:

an outer case that defines an outer appearance;

a door liner that is coupled to the outer case, the door liner defining a rear surface of the door part in which a recess part configured to accommodate the driving device is defined;

an insulation material filled between the outer case and the door liner; and a door cover that is mounted on the door liner and that covers the driving device.

11. The refrigerator according to claim 10, wherein the door cover extends vertically higher than the lighting module and is disposed at a rear side of the door liner to cover the lighting module.

12. The refrigerator according to claim 10, wherein an extension part that is stepped is disposed on a lower end of the upper air guide, and wherein the door cover extends upward to an upper end of the extension part to cover the lighting cover.

13. The refrigerator according to claim 10, wherein a lower end of the upper air guide and an upper end of the door cover contact each other such that cool air guided by the upper air guide flows along the door cover.

14. The refrigerator according to claim 10, wherein a lower end of the door cover includes a lower air guide that protrudes rearward, that has an inclined or rounded shape, and that is configured to guide cold air flowing along the door cover to a lower side of the drawer part, the lower air guide being disposed vertically below the upper air guide.

15. The refrigerator according to claim 14, wherein the lower air guide protrudes downward relative to a lower end of the drawer part.

16. The refrigerator according to claim 1, wherein the drawer part comprises:

a drawer body that defines the storage space; and a plurality of metal plates mounted on inner and outer surfaces of the drawer body to cover the draw-out rail, the plurality of metal plates defining an outer appearance of the drawer body.

17. A refrigerator comprising:

a cabinet that defines a storage chamber;

a drawer door that is configured to be inserted into and withdrawn out of the storage chamber, the drawer door comprising:

a door part that is configured to open and close the storage chamber, the door part having a lower end disposed vertically above a bottom of the cabinet and an upper end disposed vertically above the lower end of the door part, and a drawer part disposed at a rear side of the door part and defining a storage space;

a door frame that couples the door part to the drawer part in a state in which they are spaced apart from each other;

an upper air guide disposed on a rear surface of the door part, the upper air guide being disposed vertically higher than the upper end of the drawer part and configured to guide cold air to a space between the door part and the drawer part; and a lower air guide disposed on the rear surface of the door part, the lower air guide being disposed vertically lower than the lower end of the drawer part and configured to guide the cold air guided by the upper air guide rearward from a front side along a bottom surface of the drawer part.

18. The refrigerator according to claim 17, wherein the upper air guide protrudes rearward from a lower side of the door part toward an upper side of the door part and has an inclined or rounded shape, and wherein the lower air guide protrudes from the upper side of the door part toward the lower side of the door part and has an inclined or rounded shape.

19. The refrigerator according to claim 17, wherein a lighting unit is disposed on the rear surface of the door part, the lighting unit being disposed above the drawer part and configured to emit light to the drawer part, and wherein the upper air guide is disposed on the lighting unit.

20. The refrigerator according to claim 19, wherein the lighting unit extends in a horizontal direction along a width of the drawer part and has a width equal to or greater than that of the drawer part.

* * * * *